US007744546B2

(12) United States Patent
Lee

(10) Patent No.: US 7,744,546 B2
(45) Date of Patent: Jun. 29, 2010

(54) APPARATUS AND METHOD FOR LOWER-LIMB REHABILITATION

(75) Inventor: Yang Soo Lee, Daegu (KR)

(73) Assignee: Kyungpook National University Industry-Academic Cooperation Foundation, Daegu (KR)

( * ) Notice: Subject to any disclaimer, the term of this patent is extended or adjusted under 35 U.S.C. 154(b) by 988 days.

(21) Appl. No.: 11/504,234

(22) Filed: Aug. 15, 2006

(65) Prior Publication Data

US 2007/0043308 A1 Feb. 22, 2007

(30) Foreign Application Priority Data

Aug. 22, 2005 (KR) ..... 10-2005-0076653

(51) Int. Cl.
*A61H 1/00* (2006.01)

(52) U.S. Cl. ..... 601/33; 601/24

(58) Field of Classification Search ..... 601/5, 601/23, 24, 26, 27, 33, 34, 35; 602/32–36; 606/237, 240–245; 482/142; 128/845; 5/609, 5/617, 618

See application file for complete search history.

(56) References Cited

U.S. PATENT DOCUMENTS 5,500,002 A * 3/1996 Riddle et al. ..... 606/242
6,007,568 A * 12/1999 Harrell et al. ..... 606/242
6,692,451 B2 * 2/2004 Splane, Jr. ..... 601/5
6,960,174 B2 * 11/2005 Fenkel ..... 606/241
7,341,565 B2 * 3/2008 Splane et al. ..... 601/5

* cited by examiner

*Primary Examiner*—Quang D Thanh
(74) *Attorney, Agent, or Firm*—Husch Blackwell Sanders LLP

(57) ABSTRACT

The invention relates to an apparatus for rehabilitation treatment of patients with lower limb paralysis or physical strength weakening, and more particularly, to an apparatus and method for lower limb rehabilitation treatment and exercise. The apparatus and method allows a user to exercise both lower limbs separately, and which can detect changes in the angle of lower limb joints and the magnitude of weight loaded on lower limbs to determine the exercise condition, exercise intensity and motor ability of the respective lower limbs to provide corresponding feedback to the user, thereby enabling effective rehabilitation treatment.

31 Claims, 14 Drawing Sheets

APPARATUS AND METHOD FOR LOWER-LIMB REHABILITATION

CLAIM TO PRIORITY

The present application claims priority to Korean Patent Application No 2005-76653, filed Aug. 22, 2005, entitled "Rehabilitation Equipment for Lower Limb and Rehabilitation Method of the same".

BACKGROUND OF THE INVENTION

1. Field of the Invention

The present invention relates to an apparatus for rehabilitation treatment of patients with lower limb paralysis or physical strength weakening, and more particularly, to an apparatus and method for lower limb rehabilitation treatment and exercise, which allows a user to exercise both lower limbs separately, and which can detect changes in the angle of lower limb joints and the magnitude of weight loaded on lower limbs to determine the exercise condition, exercise intensity and motor ability of the respective lower limbs to provide corresponding feedback to the user, thereby enabling effective rehabilitation treatment.

2. Description of the Related Art

Paralysis or partial paralysis (hereinafter will be referred to as "partial paralysis") originating from apoplexy, traumatic brain damage, cerebral palsy and so on is a motor paralysis that paralyzes muscles or motors so that the paralyzed or affected muscles cannot exert power to a proper extent at necessary moments. In order to treat the patient with partial paralysis, it is possible to use several methods such as physical strengthening, muscle controlling, extending, balancing and so on. As a rehabilitation exercise of the patient with upper-limb partial paralysis, a treatment for forcing the patient to use the paralyzed upper limb is being recognized as the most successful among several rehabilitation exercises.

In 1994, it was reported by Nugent et al, when patients with apoplexy capable of standing erect perform weight loading, improvement in walking was more apparent as the weight loading is repeated more.

Accordingly, the inventor proposed a sliding board exercise apparatus for rehabilitation treatment that induces forced use of lower limbs as disclosed in Korean Patent Application No. 10-2004-0016844. With this apparatus, a patient can lie on a board with the back or stomach touching the board in a stable posture with feet seated on a footing, and then take an exercise of flexing and extending knees without any feeling of uneasiness. Furthermore, the patient can take a patient-specified rehabilitation exercise by adjusting the slant of the board.

The sliding board exercise apparatus for rehabilitation treatment of the inventor has a footing integrated with a fixed frame in which both lower limbs of the patient are supported on the footing. So, there has been a problem in that when the patient with partial paralysis performs loading the weight on the lower limbs for rehabilitation treatment, he/she unconsciously loads the weight on the normal or unaffected lower limb thereby reducing the effect of exercise.

Furthermore, in order to exercise normal walking by continuously changing the angle of the joints of both lower limbs while shifting the weight, motors or muscles in use for weight-shift should be exercised simultaneously with those in use for changing the joint angle. However, Korean Patent Application No. 10-2004-0016844 does not provide any means for detecting the joint angle, and thus the user cannot recognize whether or not the joint of the paralyzed lower limb is used. This as a drawback disables effective rehabilitation exercise for normal walking.

A normal walking is performed by repeatedly flexing the knee of a lower limb at about 15° to support the weight. In the rehabilitation treatment for exercising the normal walking, it should be detected whether or not weight shifting and joint angle change are systematically combined together. However, since this cannot be confirmed in the prior art, the rehabilitation treatment is restricted to the repetition of simple actions of flexing/extending knees.

Accordingly, there is a need for an apparatus for lower limb rehabilitation treatment capable of allowing a user to take an exercise in a lying posture so that the user can feel comfortable without having any feeling of uneasiness to potentially fall down and to adjust the height of a sliding backing plate so that the user can easily raise exercise intensity. There is another need for an apparatus for lower limb rehabilitation treatment that can be easily mounted, used to measure weight load and joint movement, and constituted of inexpensive equipments. Furthermore, there is need for a method for lower limb rehabilitation exercise that can notify a patient in real-time of his/her condition measured by the apparatus so that the patient can perform the rehabilitation treatment without being bored.

SUMMARY OF THE INVENTION

The present invention has been made to solve the foregoing problems of the prior art and it is therefore an object of the present invention to provide an apparatus and method for lower limb rehabilitation treatment and exercise, which has a sliding backing plate on which a user can take exercise in a lying posture, feeling comfortable without having to worry about injuries that may occur when the user fails to apply power properly to the lower limb during exercise, and separate weigh-loading parts on which both lower limbs are separately supported so that the user can have rehabilitation exercise for only one lower limb if necessary.

It is another object of the invention to provide an apparatus for lower limb rehabilitation treatment that can make a specified treatment apparatus set to the respective figure of a number of users through adjustment in the height of the sliding backing plate and the height of right and left footings. It is further another object of the invention to provide an apparatus for lower limb rehabilitation treatment that enables users to fix the calf to the apparatus so that even those who can hardly adjust the adduction and abduction of the lower limb can take rehabilitation treatment in a posture that knees are not biased inward or outward of the lower limbs.

It is yet another object of the invention to provide an apparatus and method for lower limb rehabilitation treatment and exercise that can detect in real-time weight loaded on lower limbs and the angle of lower limb joints to determine the condition of a user in order to inform the user in real-time of the determined condition as well as to represent data of the paralyzed and unaffected lower limbs so that the user can promptly recognize his/her condition and easily take exercise the paralyzed lower limb focused to the unaffected lower limb.

In order to realize the above objects, the invention provides an apparatus for lower limb rehabilitation. The apparatus includes a base frame supported on a bottom; an elevation frame arranged to be driven up/down to a predetermined height from the base frame, in parallel therewith; a variable jig for supporting the elevation frame above the base frame, allowing the elevation frame to be driven up/down; an elevator arranged on the base frame for adjusting the axial width of the variable jig in order to drive up/down the elevation frame; a table including a pivotal coupling part formed in a lower position for pivoting with one edge of the elevation frame as a vertex, a backing plate part having a sliding backing plate arranged above the pivotal coupling part for sliding up and down while supporting an upper body of a patient, and a pair of footings arranged under the backing plate to support the weight of the patient, each of the footings being adjustable in height; and a slant adjusting unit mounted on the elevation for driving the table to pivot to a predetermined angle about the pivotal coupling part to erect or lie.

Preferably, the variable jig has a hinge part including two bars at an X-shaped crossing so that the distance between y axes is varied in reverse proportion to variation in the distance between x axes, wherein upper and lower ends of one side of the hinge part are pivotally fixed to the elevation frame and base frame, respectively, thereby forming fixing ends, and upper and lower ends of the other side of the hinge part are coupled to the elevation frame and base frame, respectively, movable in x-axial direction, thereby forming free ends.

Preferably, the backing plate part may have a number of rolling bearings at both sides underneath the sliding backing plate, the rolling bearings inserted into guide rails arranged at both sides of the table to enable rolling, so that the sliding backing plate supporting the weight of the patient smoothly slides up and down at an entire, adjustable slant angle of the table.

The apparatus for lower limb rehabilitation of the invention may further include shoulder supports arranged at both sides of the sliding backing pate to support shoulders of the patient, respectively, so that when the sliding backing plate is slid up, the weight of the sliding backing plate is supported on the shoulders of the patient.

Preferably, the footings may be separated from each other to a suitable distance in the longitudinal direction of the table, and coupled with a pair of rails, respectively, in a slidable fashion, thereby enabling stepwise height adjustment.

The apparatus for lower limb rehabilitation of the invention may further include reciprocating sliders to surround the exterior of the rails, respectively, wherein lower ends of the reciprocating sliders are hinged to one ends of the both footings, respectively, both ends of arm members adjustable in distance are pivotally coupled to the other ends of the both footings and the other ends of the reciprocating sliders, respectively, and the angle of the both footings is adjusted as the arm members are adjusted in distance.

The apparatus for lower limb rehabilitation of the invention may further include a pair of calf-backing plates detachably arranged between the rails, wherein one of the calf-backing plates for an unaffected lower limb is removed in partial paralysis rehabilitation treatment so that a partially paralyzed lower limb is exercised intensively.

In addition, the apparatus for lower limb rehabilitation of the invention may further include a goniometer arranged at one lateral side of the table.

In order to realize the above objects, the invention also provides an apparatus for lower limb rehabilitation. The apparatus includes a base frame supported on a bottom; an elevation frame arranged to be driven up/down to a predetermined height from the base frame, in parallel therewith; a variable jig for supporting the elevation frame above the base frame, allowing the elevation frame to be driven up/down; an elevator arranged on the base frame for adjusting the axial width of the variable jig in order to drive up/down the elevation frame; a table including a pivotal coupling part formed in a lower position for pivoting with one edge of the elevation frame as a vertex, a backing plate part having a sliding backing plate arranged above the pivotal coupling part for sliding up and down while supporting an upper body of a patient, the backing plate part capable of detecting the vertical position of the backing plate part, a pair of footings arranged under the backing plate to support the weight of the patient, each of the footings being adjustable in height and capable of loading the weight of a user thereon, and a calf-fixing part for contacting calves of lower limbs to prevent knees of the user from biasing inward or outward of the lower limbs; a slant adjusting unit mounted on the elevation for driving the table to pivot to a predetermined angle about the pivotal coupling part to erect or lie; a controller for generating joint angle data of measurement data about the angle of a joint by judging the angle of the joint based upon the position of the sliding backing plate detected by the backing plate part, generating 'weight data of measurement data' about the weight of the user loaded on each of the lower limbs detected by each of the footings, and generating result data based upon weight data and joint angle data of measurement data obtained from an unaffected lower limb and the weight data and joint angle data of measurement data; and a display part for displaying the result data generated by the controller to the user.

Preferably, the variable jig may have a hinge part including two bars at an X-shaped crossing so that the distance between y axes is varied in reverse proportion to variation in the distance between x axes, wherein upper and lower ends of one side of the hinge part are pivotally fixed to the elevation frame and base frame, respectively, thereby forming fixing ends, and upper and lower ends of the other side of the hinge part are coupled to the elevation frame and base frame, respectively, movable in x-axial direction, thereby forming free ends.

Preferably, the backing plate part may have a number of rolling bearings at both sides underneath the sliding backing plate, the rolling bearings inserted into guide rails arranged at both sides of the table to enable rolling, so that the sliding backing plate supporting the weight of the patient smoothly slides up and down at an entire, adjustable slant angle of the table. Furthermore, the apparatus for lower limb rehabilitation may further include shoulder supports arranged at both sides of the sliding backing pate to support shoulders of the patient, respectively, so that when the sliding backing plate is slid up, the weight of the sliding backing plate is supported on the shoulders of the patient.

Preferably, the backing plate part may have a number of distance sensors arranged in a top portion of the table for locating the sliding backing plate, whereby the distance sensors detect the distance from the top part of the table to the sliding backing plate to locate the sliding backing plate, or the backing plate part may have a number of contact sensors arranged in one or both sides of the table at a predetermined interval, for locating the sliding backing plate, whereby the sliding backing plate is located by detecting the position of each of the sensors contacted by the sliding backing plate.

In addition, the apparatus for lower limb rehabilitation may further include a fixing part attached to a bottom portion of the sliding backing plate, wherein arm members adjustable in distance are pivotally coupled inside the fixing part, whereby the sliding backing plate is adjusted in height through the distance adjustment of the arm members.

Preferably, the footings may be separated from each other to a suitable distance in the longitudinal direction of the table, and coupled with a pair of rails, respectively, in a slidable fashion, thereby enabling stepwise height adjustment. The apparatus for lower limb rehabilitation may further include reciprocating sliders to surround the exterior of the rails, respectively, wherein lower ends of the reciprocating sliders are hinged to one ends of the both footings, respectively, both ends of arm members adjustable in distance are pivotally coupled to the other ends of the both footings and the other ends of the reciprocating sliders, respectively, and the angle of the both footings is adjusted as the arm members are adjusted in distance. In addition, the apparatus for lower limb rehabilitation may further include a pair of calf-backing plates detachably arranged between the rails.

Preferably, the footings may have a number of sensors directly or indirectly contacting lower surfaces of the lower limbs of the user, the sensors changing state owing to the weight loaded on the lower limbs, whereby the weight loaded on the lower limbs is detected based upon the state changes of the sensors.

Preferably, the calf-fixing part may include a U-shaped contact plate contacting the calves of the user, connecting hooks placed between the footings and the contact plate and arranged in different heights on the footings and at least one connecting rod pivotally coupled with a portion of the contact plate, wherein the connecting hooks of the contact plate are selectable to match the figure of the user. Also, the contact plate may further include an attachment that surround the calf of each lower limb of the user to completely contact the calf, one portion of the attachment fixed to one portion of the contact plate and the other portion of the attachment attachable/detachable to/from the other portion of the contact plate.

Preferably, the reference data may be measurement data obtained from paralyzed and unaffected lower limbs or stored measurement data of an unaffected person.

Preferably, the controller may generate state data through measurement data and reference data, and generates result data including the measurement data, reference data and state data.

Preferably, the controller may have a timer to measure time until the weight data of measurement data becomes a same value in next time, generate time data from the measured time, and add the time data to the measurement data. More preferably, the result data may include the time data.

Preferably, the controller may generate a game using the result data as variables and forward the game to the display part, thereby to stimulate the user to feel more interest in the exercise.

In order to realize the above objects, the invention further provides a method for lower limb rehabilitation treatment using the apparatus as defined above. The method includes steps of:

(a) measuring weight load on at least one lower limb detected by at least one of the footings, based upon state change of a pressure sensor or a spring of the footings, to generate weight data of measurement data about the loaded weight, and measuring the angle of a flexed joint of a user based upon the position of the sliding backing plate detected by the sensors of the backing plate part to generate joint angle data of measurement data about the measured joint angle;

(b) generating weight data and joint angle data of reference data comprising measurement data measured from paralyzed and unaffected lower limbs or measurement data of an unaffected person as data of an unaffected lower limb comparable with the weight data and joint angle data of measurement data;

(c) generating state data through the weight data of measurement data and the weight data of reference data;

(d) generating result data including the weight data and joint angle data of reference data, the weight data and joint angle data of measurement data and the state data; and (e) outputting and displaying the result data to the user.

The method may further include a step of adding, to the measurement data, time data obtained by measuring time until the weight data of measurement data becomes a same value; and adding the time data of measurement data to the result data.

In addition, the method may further include a step of receiving basic information of the user before the step (a), in which the basic information of the user is used preferably to generate the reference data.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Hereinafter, exemplary embodiments of the present invention will be described in detail with reference to the accompanying drawings.

Figure 1:
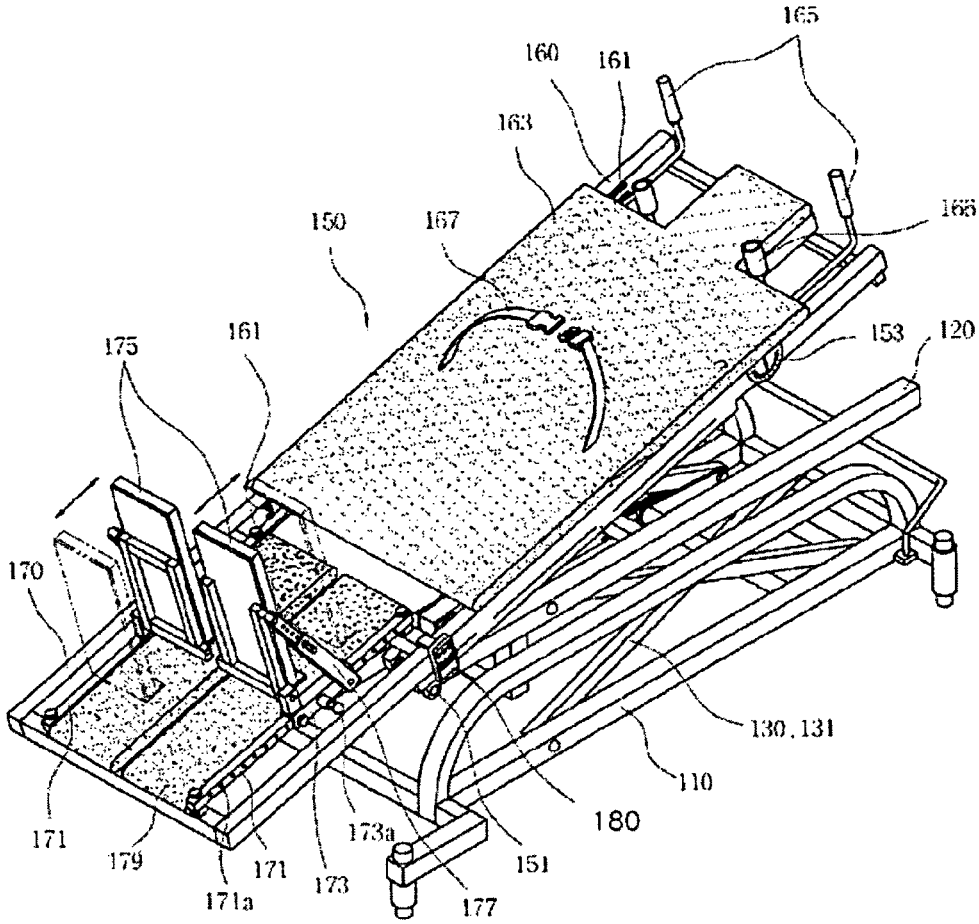
FIG. 1 is a perspective view illustrating an apparatus for lower limb rehabilitation treatment according to a first embodiment of the invention.
Figure 2:
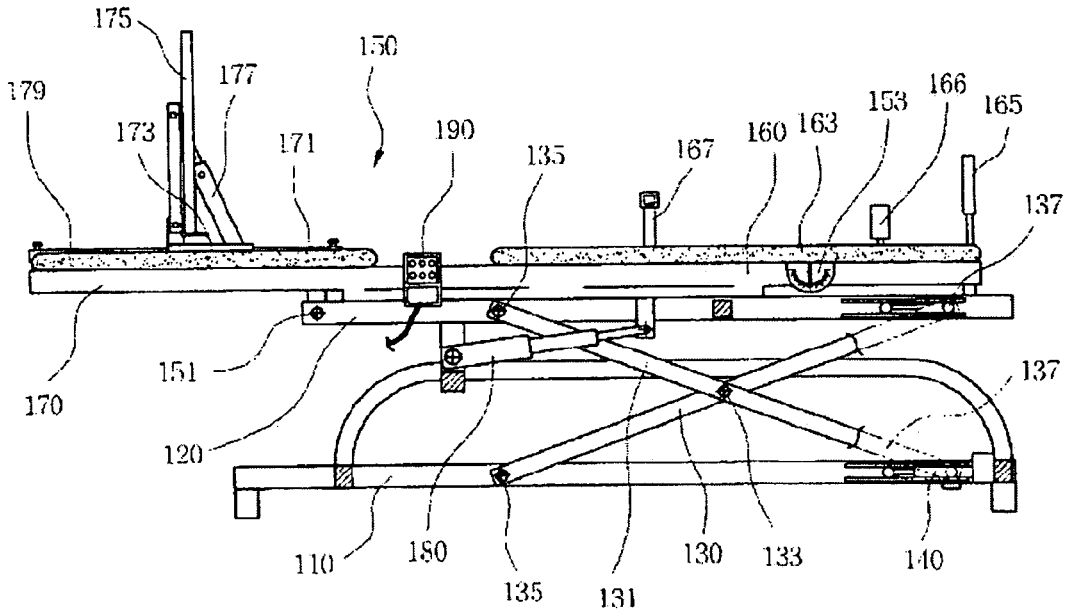
FIG. 2 is a side elevation view illustrating the apparatus for lower limb rehabilitation treatment of the invention, with a table in a lying position.
Figure 3:
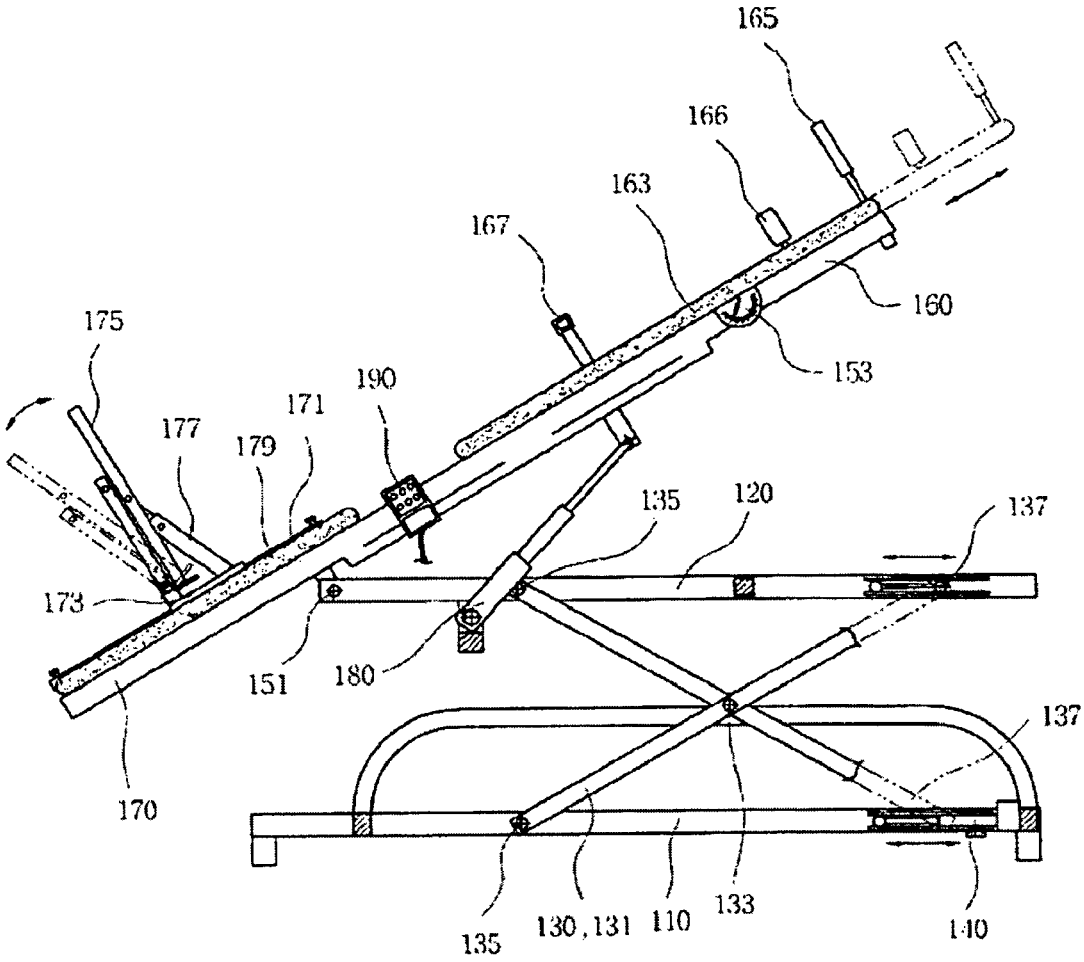
FIG. 3 is a side elevation view illustrating the apparatus for lower limb rehabilitation treatment of the invention, with the table in a standing position.

The invention will first be described with reference to FIGS. 1 to 3, in which FIG. 1 is a perspective view illustrating an apparatus for lower limb rehabilitation treatment according to a first embodiment of the invention, FIG. 2 is a side elevation view illustrating the apparatus for lower limb rehabilitation treatment of the invention, with a table in a lying position, and FIG. 3 is a side elevation view illustrating the apparatus for lower limb rehabilitation treatment of the invention, with the table in a standing position.

As illustrated in FIGS. 1 to 3, an apparatus for lower limb rehabilitation according to the invention comprises a base frame 110 supported on a floor, an elevation frame 120 installed to be raised/lowered with respect to the base frame 110 by a predetermined height in a horizontal state, a variable jig 130 supporting the elevation frame 120 above the base frame 110 in a raisable/lowerable way, an elevation unit 140 installed to the base frame 110 and adjusting an axial length of the variable jig 130 to raise/lower the elevation frame 120, a table 150 having a pivotal coupling part 151 formed to pivot about one end of the elevation frame 120 at a predetermined lower position thereof, a backing plate part 160 formed to support the upper part of a patient's body on an upper side of the pivotal coupling part 151, a footing part 170 with height-adjustable left/right footings 175 installed to withstand a patient's weight on a lower side of the backing plate part 160 so as to enable a patient to stand, and a tilt adjustor 180 mounted on the elevation frame 120 and pivoting the table 150 about the pivotal coupling part 151 at a predetermined angle up to a horizontal/tilt position.

The variable jig 130 is so constructed that two bars 131 forms a hinge part 133 at an X shaped intersect so as that x- and y-axial distances are varied in inverse proportion to each other, that one ends of the two bars 131 located above and below the hinge part 133 respectively are formed into fixed ends 135, which are pivotally fixed to the elevation frame 120 and base frame 110, and that the other ends of the two bars 131 located above and below the hinge part 133 respectively are formed into free ends 137, which are coupled to the elevation frame 120 and base frame 110 so as to be movable in an x-axial direction.

Each elevation unit 140 is preferably constructed as a hydraulic cylinder, one end of which is fixed to the base frame 110, and the other is connected with the free end 137 of one bar 131 of the variable jig 130, thereby pushing and pulling the free end 137. As a result, the x- and y-axial distances of the variable jig 130 are varied, and thus the elevation frame 120 supported by the variable jig 130 is raised/lowered, and then the table 150 is raised/lowered.

The backing plate part 160 has a plurality of rolling bearings (not shown) on left and right sides of the bottom of a slide back plate 163. The rolling bearings are retained in guide rails 161 formed on left and right sides of the table 150, thereby making a rolling motion. Thus, the slide back plate 163 smoothly slides in an upward or downward direction within an overall adjustable tilt angle of the table 150 while supporting the patient's weight.

At this time, the slide back plate 163 is formed with auxiliary handgrips 165 on left and right sides of upper ends thereof so as to enable the patient to grasp them by the hands to assume a stable posture. The auxiliary handgrips 165 are installed on left and right sides of the patient's body, but they can be installed anywhere as long as the patient can grasp them in a most comfortable posture.

Further, the upper ends of the slide back plate 163 are preferably formed on the left and right sides thereof with shoulder support rods 166 so as to allow a load of the slide back plate 163 to be supported on patient's shoulders when the slide back plate 163 is pushed in an upward direction.

In addition, the slide back plate 163 may be additionally provided with a safety belt 167 on a middle lower side thereof so as to fix a patient's waist, thereby preventing the patient's waist from escaping from the safety belt 167.

The footing part 170 has a pair of rails 171 which are detachably coupled in a lengthwise direction of the table 150 and spaced a predetermined distance apart from each other. The footing part 170 has left/right footings 175, which are slidably coupled on the rails 171. Thereby, the left/right footings 175 have a stepwise height-adjustable construction.

At this time, each rail 171 is coupled with a reciprocating slider 173 so as to enclose an external profile thereof. One end of each reciprocating slider 173 is hinged to one end of each footing 175. The other end of each reciprocating slider 173 and the other end of each footing 175 are coupled to both ends of each distance-adjustable arm member 177 in a pivotal state. As the arm members 177 are adjusted in distance, the left/right footings 175 are adjusted in installation angle.

Here, each rail 171 is formed in an angled rod shape, a plurality of fixing holes 171*a* are formed at one side of the rail 171 at an equal interval. Further, the reciprocating sliders 173 are coupled on the rails 171 to slide along the same, and height fixing levers 173*a* capable of detachably coupling into the fixing holes 171*a* are formed in the sliders 173, respectively, so that the left/right footings 175 are fixed after height adjustment.

At this time, left/right calf bearing boards 179 are additionally provided between the pair of rails 171. The calf bearing boards 179 can be disassembled.

In the footing part 170, the left/right footings 175 can be adjusted to have a different height, or one of the rails 171 can be completely separated from the footing part 170. Thereby, the footing part 170 allows a hemiplegic or partially paralyzed lower limb, only one limb requiring rehabilitation, to be used for exercise, so that it can enhance a rehabilitation effect.

Here, when one of the calf bearing boards 179 requiring no rehabilitation is separated together, the rehabilitation effect can be more enhanced.

The table 150 is provided with an analog goniometer 153 on one side thereof so as to be able to check how the table is inclined, as illustrated in FIGS. 1 to 3. Alternatively, a digital goniometer may be used.

The tilt adjustor 180 can be constructed as a hydraulic cylinder, one end of which is supported on the elevation frame 120, and the other is coupled on a bottom of the table 150. Thus, the tilt adjustor 180 is adjusted in distance, thereby adjusting a tilt angle of the table 150.

At this time, the elevation unit 140 and tilt adjustor 180 can be activated through a remote controller 190, so that they can promote a user's convenience.

Hereinafter, rehabilitation examples of using the apparatus for lower limb rehabilitation according to the present invention constructed as mentioned above will be described.

First, this test was directed to a 67-year-old male patient, a subject, who had a good muscular strength on an affected or paralyzed side, could independently achieve functional ambulation, and had a left paralysis.

After active electrodes were attached to both vastus lateralis muscles, and reference electrodes were attached on both knees using a dynamic electromyograph for the subject, standing in a sitting posture (i.e. sit-to-stand), flexion and extension of both knee joints on a stall bar, and flexion and extension of both knee joints at the apparatus for lower limb rehabilitation according to the present invention are performed. At this time, muscular activities representing the vastus lateralis muscles were measured, and then left and right differences based on the respective movements were compared.

First, while the sit-to-stand was repeated twice, the muscular activities at the vastus lateralis muscles were measured. After taking a rest for 10 minutes whenever examining a different motion, while flexing and extending of both knees on the stall bar and the apparatus for lower limb rehabilitation according to the present invention were performed twice in the same method, the muscular activities at the vastus lateralis muscles were measured.

Further, in the apparatus for lower limb rehabilitation according to the present invention, while the flexion and extension of the knee joints using both lower limbs as well as using only one affected lower limb were performed twice, the muscular activities at the vastus lateralis muscles were measured and compared.

As the dynamic electromyography, an MP100 model available from BIOPAC System Company was used. The electrodes employed surface electrodes, and the muscular activities at the vastus lateralis muscles were mean voltages displayed on the dynamic electromyography.

The test was carried out under the above-mentioned conditions, and test results could be obtained as in Table 1 below:

TABLE 1

Mean Voltages from Dynamic EMG and Lt/Rt Ratio

| Type of Procedures | Right (volts) | Left (volts) | Left/Right Ratio |
|---|---|---|---|
| Sit-to-stand | 0.622 | 0.471 | 0.76 |
| Tilt-table | 0.281 | 0.216 | 0.77 |
| Sliding-machine (both) | 0.241 | 0.219 | 0.91 |
| Sliding-machine (affected) | 0.072 | 0.427 | 5.93 |

First, the mean potential values at the vastus lateralis muscles obtained while the sit-to-stand was repeated twice showed 0.622V for right and 0.471V for left, and thus the left/right ratio was 0.76.

When the flexion and extension of the knee joints on the stall bar were repeated twice, the recorded mean potential values at the vastus lateralis muscles showed 0.281V for right and 0.216V for left, and thus the left/right ratio was 0.77.

When the flexion and extension of the knee joints using both lower limbs at the apparatus for lower limb rehabilitation according to the present invention were repeated twice, the recorded mean potential values at the vastus lateralis muscles showed 0.241V for right and 0.219V for left, and thus the left/right ratio was 0.91.

When the flexion and extension of the knee joints using only one affected lower limb at the apparatus for lower limb rehabilitation according to the present invention were repeated twice, the recorded mean potential values at the vastus lateralis muscles showed 0.072V for right and 0.427V for left, and thus the left/right ratio was 5.93.

As can be seen through the results in Table 1 above, it can be found that the unaffected vastus lateralis muscle had a higher muscular activity than the affected vastus lateralis muscle when the subject performed the sit-to-stand, the flexion and extension of both knee joints on a stall bar, and the flexion and extension of both knee joints using both lower limbs at the apparatus for lower limb rehabilitation according to the present invention, but the muscular activity at the unaffected vastus lateralis muscle was remarkably decreased, whereas the muscular activity at the affected vastus lateralis muscle was relatively increased when the subject performed the flexion and extension of both knee joints using only one affected limb at the apparatus for lower limb rehabilitation according to the present invention.

Further, it can be found that the ratio of the muscular activities at the affected and unaffected vastus lateralis muscles was remarkably increased as compared to other motion, when the subject makes a motion using only one affected limb at the apparatus for lower limb rehabilitation according to the present invention.

As set forth above, the apparatus for lower limb rehabilitation according to the present invention makes possible the user to move the affected limb along a closed orbit, eccentrically, and concentrically as well as forced use of the affected limb. In addition, the user can adjust a motion load by adjusting the slant, and can quantify the motion.

Further, on getting an exercise for a load of body's weight on the affected limb, there is a need for help from a therapist. However, the apparatus for lower limb rehabilitation according to the present invention is so designed that manipulation using the remote controller 190 is easy, and the patient is easy to get on and off the table 150, so that the patient and his/her curator can easily get an exercise without help of the therapist.

According to these embodiments, the muscular activity at the unaffected vastus lateralis muscle is remarkably decreased, and the muscular activity at the affected vastus lateralis muscle is relatively increased by making possible coercive use of the paralyzed lower limb when the subject performed the flexion and extension of both knee joints using only one affected limb. Furthermore, it is possible to make an obstructive orbital motion, eccentric motion, and concentric motion of the affected limb at the same time including the coercive use of the affected limb, to adjust a motion load by adjusting the slant, and to quantify the motion.

Further, when getting an exercise for a load of body's weight on the affected limb, there is a need for help from a therapist. However, the apparatus for lower limb rehabilitation according to the present invention is so designed that manipulation using the remote controller is easy, and the patient is easy to get on and off the table, so that the patient and his/her curator can easily get an exercise without help of the therapist.

Figure 4A:
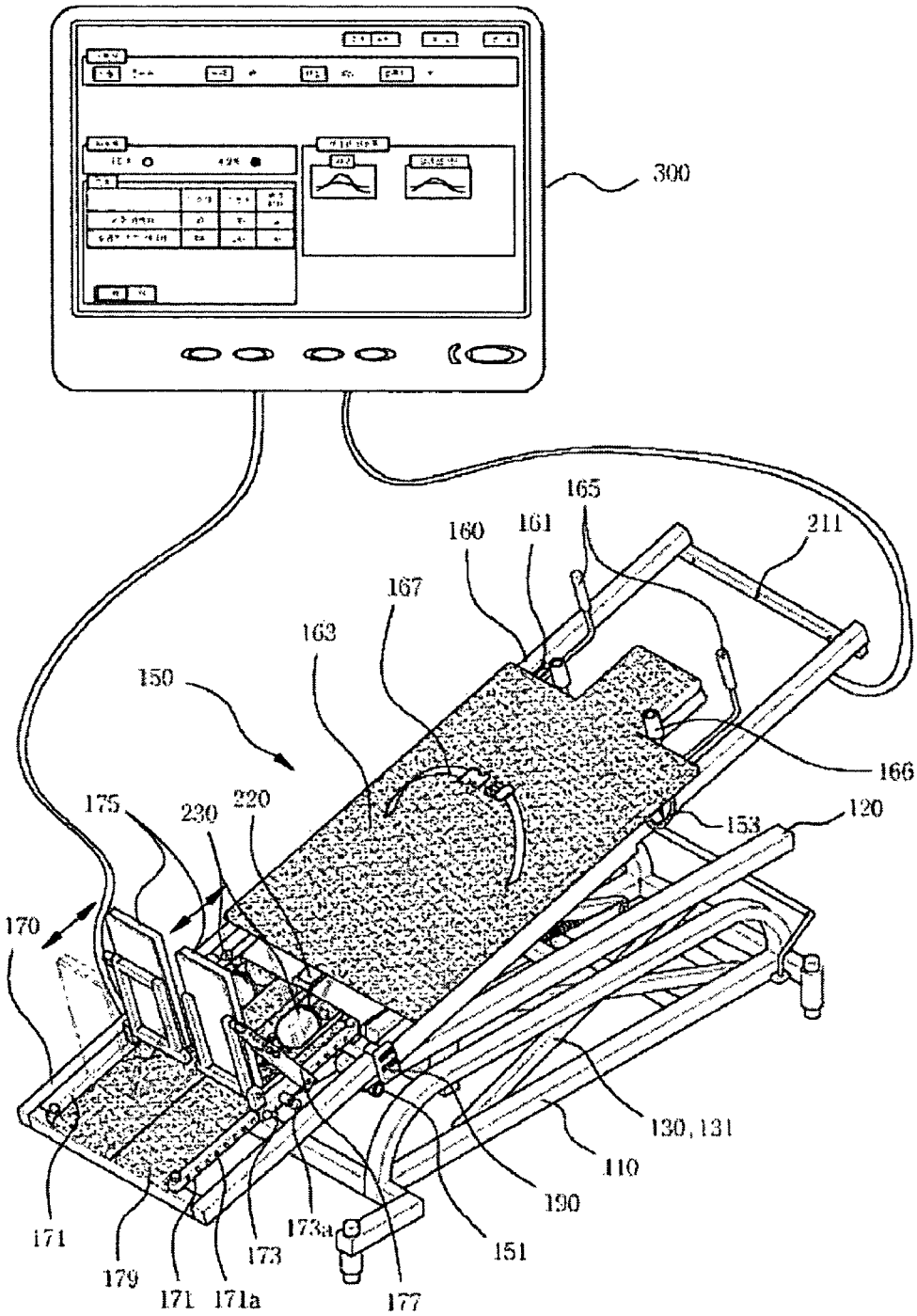
FIGS. 4*a* to 4*d* are perspective views illustrating an apparatus for lower limb rehabilitation treatment according to a second embodiment of the invention.
Figure 4B:
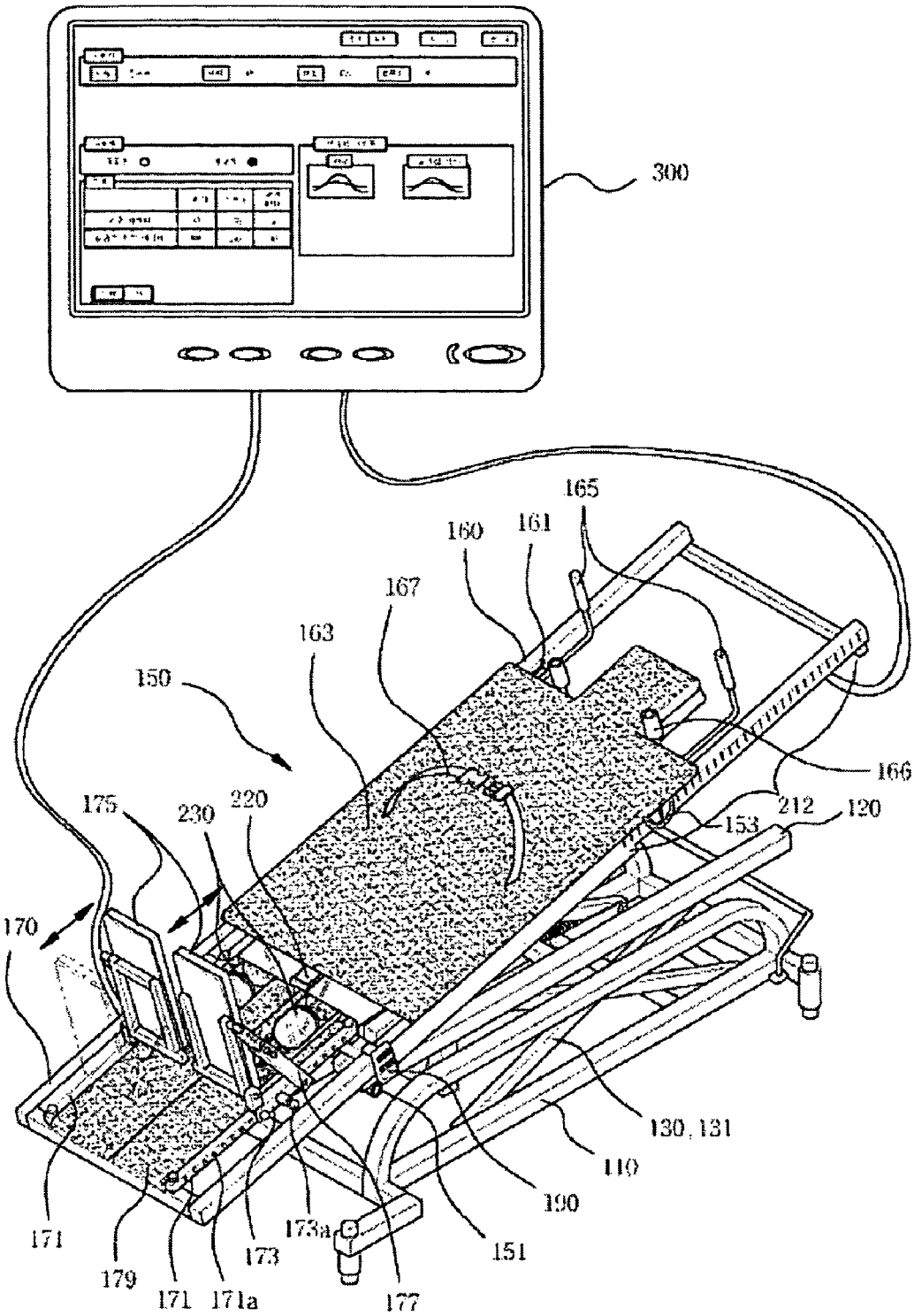
Figure 4C:
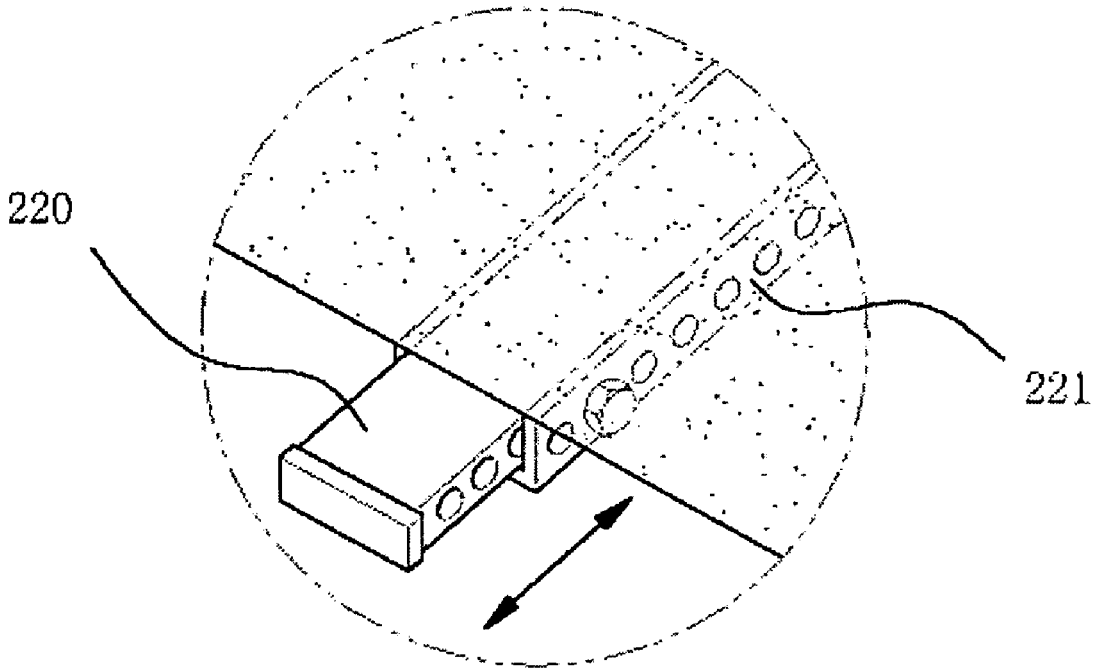
Figure 4D:
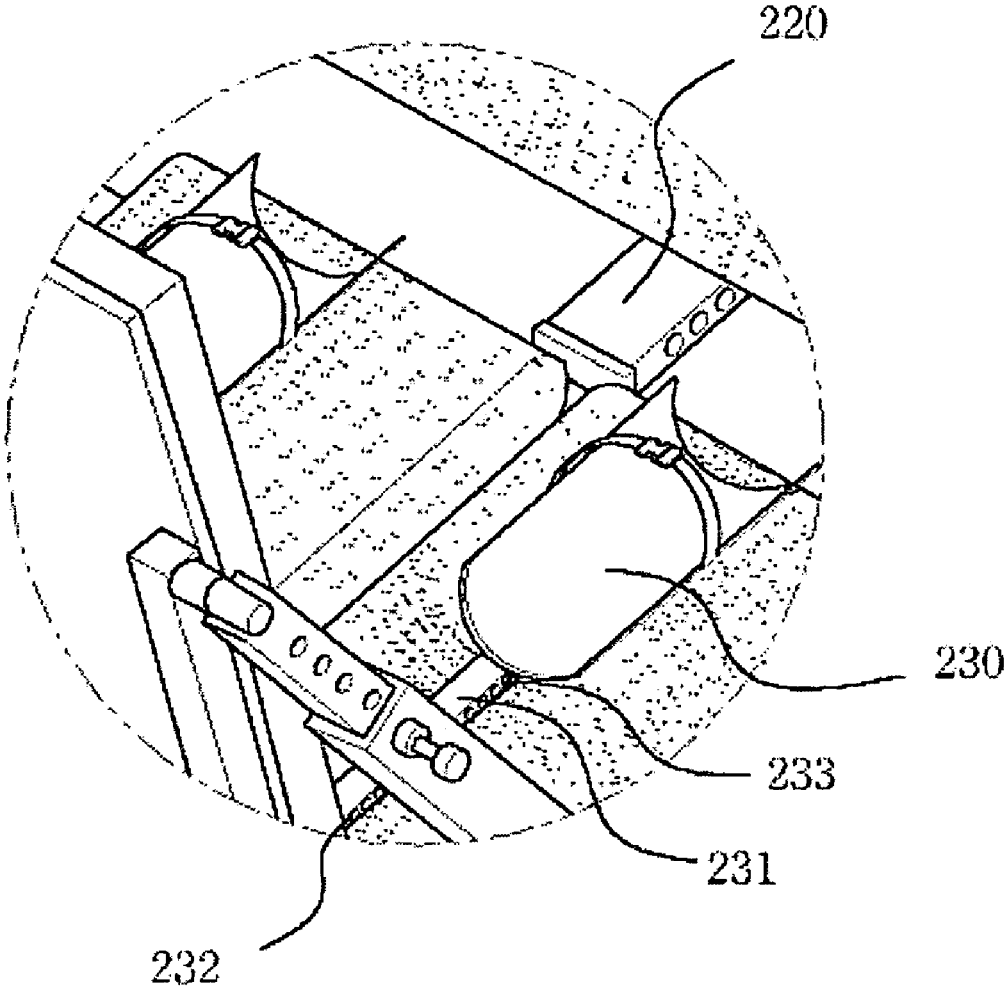
Figure 5:
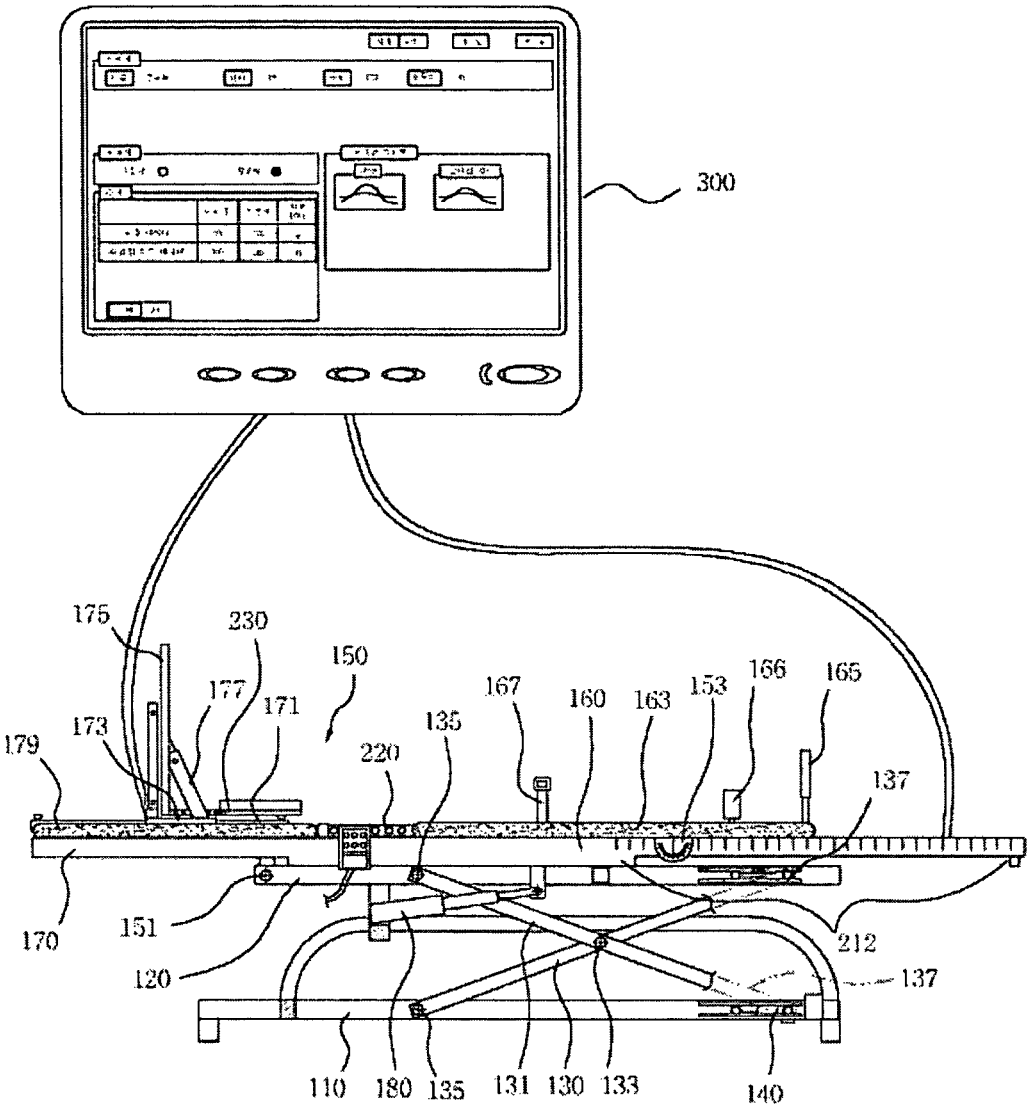
FIG. 5 is a side elevation view illustrating the apparatus for lower limb rehabilitation treatment of the invention, with a table in a lying position.
Figure 6:
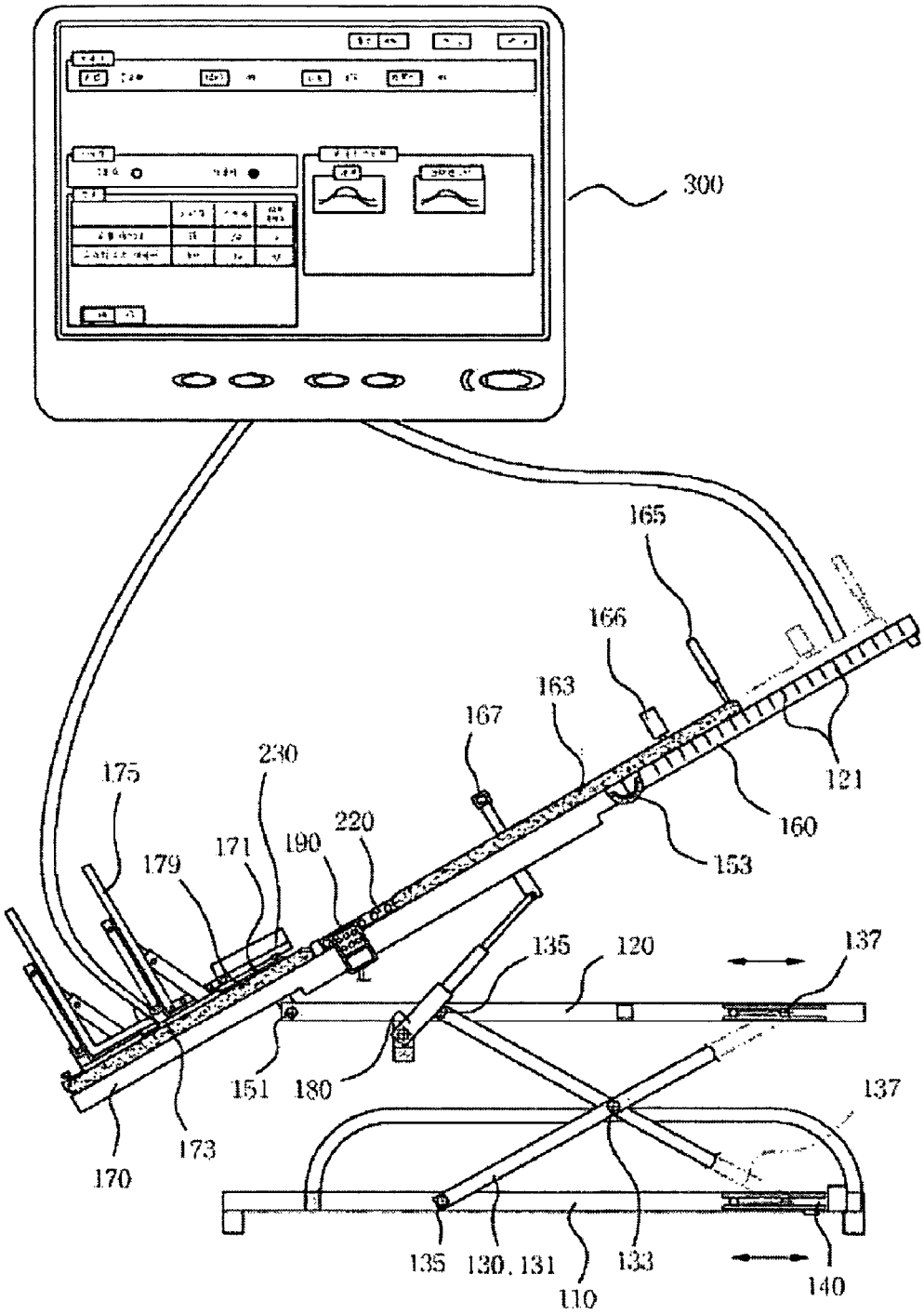
FIG. 6 is a side elevation view illustrating the apparatus for lower limb rehabilitation treatment of the invention, with the table in a standing position.

Now an apparatus and method for rehabilitation treatment and exercise will be described in detail with reference to FIGS. 4*a* to 6, in which FIGS. 4*a* to 4*c* are perspective views illustrating an apparatus for lower limb rehabilitation treatment according to a second embodiment of the invention, FIG. 5 is a side elevation view illustrating the apparatus for lower limb rehabilitation treatment of the invention, with a table in a lying position, and FIG. 6 is a side elevation view illustrating the apparatus for lower limb rehabilitation treatment of the invention, with the table in a standing position.

As illustrated in FIGS. 4*a* to 6, the hemiplegia rehabilitation equipment for the lower limbs according to the present invention includes a base frame 110 supported on the bottom; a lift frame 120 installed to move up and down horizontally to a height from the base frame 110; a movable jip 130 for supporting on the base frame 110 the lift frame 120 in moved up and down; a lift device 140 installed on the base frame to control an axial width length of the movable jig 130, thereby moving up and down the lift frame 120; a table 150 having a slide back plate 163 installed on one side of the lift frame 120, adjustably in height and slidably up and down in a state that the upper body of a user is supported, a back plate section 160 capable of detecting a position of the moving slider back plate 163, right/left pedals 175 installed adjustably in height to support a weight of the user at the lower portion of the back plate section 160 and to measure a load of the user supported by one lower limb, and a pedal section 170 having calf fixtures 230 and 231 connected with the right/left pedals 175 to contact the calves of the lower limbs so as for the user's knees not to be lean to inside or outside of the lower limbs; a tilting device 180 installed on the lift frame 120 to allow the table 150 to be inclined at a proper angle about a pivot 151 to stand up or lay down the table; a controller (not shown) for checking an angle of knee joint from the position of the slide back plate 163 detected by the back plat section 160 to generate measured joint angle data for joint angle and to generate measured load data for the user's load applied to one lower limb and detected by the right/left pedals 175, and comparing measured load data and measured joint angle data with reference load data and reference joint angle data for the normal lower limbs to generate result data; and a display 300 displaying to the user the result data generated by the controller.

The movable jig 130 has two bars crossed at a hinge 133 such that an x-axial distance between the two bars is in inverse proportion to a y-axial distance between the two bars. In one side of the hinge 133, the two bars have stationary ends 135 pivotally fixed to the lift frame 120 and the base frame 110, respectively. In the other side of the hinge 133, the two bars have free ends 137 x-axially movably connected to the lift frame 120 and the base frame 110, respectively.

The lift device 140 is preferably comprised of a hydraulic cylinder wherein one end thereof is fixed to the base frame 110 and the other end thereof is connected to the free ends 137 of the movable jig 130 so as to push or pull the free ends 137, thereby varying x and y-axial distances to thus move up and down the lift frame 120 and the table 150 supported by the movable jig 130.

The back plate section 160 moves the slide back plate 163, that is in support of the weight of the user within an adjustable overall tilt angle of the table 150, slidably up and down in such a way that a plurality of bearings (not shown) provided on the right/left under sides of the slide back plate 163 is inserted into the guide rails 161 provided on the right/left sides of the table 150 to render the bearings rolled therein. The bearing may be one of the rolling bearing and the sliding bearing.

The auxiliary grip portions 165 are provided on both right/left of the upper portion of the slide back plate 163 to allow the user to stably take hold. The grip portions are provided in proper position on the right/left sides as far as the user can take hold conveniently.

The shoulder support rods 166 are preferably provided at the right/left sides of the upper portion of the slide back plate 163 so as to support the slide back plate 163 by the user's shoulder when the slide back plate 163 is slid up. When the user extends his knee, the slide back plate 163 can move together with the up and down movement of the user's upper body by the shoulder support rods 166.

In addition, a safety belt 167 may be additionally installed near the center portion of the slide back plate 163 to fix the waist of the user to allow the user to conduct a rehabilitation exercise in a stable posture.

The back plate section 160 includes a plurality of sensors 211 and 212 capable of detecting a sliding position of the slider back plate 163. The rehabilitation equipment according to the present invention is characterized to predict a joint angle using a distance between the pedals and the slide back plate 163 moving up and down as the user extends or flexes his knees. When the joint angle is measured by the above method, a measuring error may occur depending upon the user's build. Accordingly, the measuring error can be preferably reduced by correcting the joint angle obtained by using the distance between the pedals and slide back plate 163 with a length (or height) of user's lower limb.

The plurality of sensors for detecting the position of the slide back plate 163, as shown in FIG. 4*a*, may be comprised of the distance sensors 211 arranged at proper intervals on the upper surface of the table 150 above the slide back plate 163. The distance sensor 211 includes a transmitter unit for sending a frequency signal, and a receiver unit for receiving a return signal reflected against an object. The distance sensor measures a distance between the sensor and the object using a time from sending a signal to receiving the signal and a characteristic of the signal. With measurement of the distance between the upper portion of the table 150 and the slide back plate 163, the position of the slide back plate 163 can be measured. Since as the distance between the slide back plate 163 and the upper portion of the table 150 is large, the slide back plate 163 is near the pedal section 170, the knee joint can be checked to be flexed to some extent. On the contrary, since as the distance between the slide back plate 163 and the upper portion of the table 150 is small, the knee joint is checked to be extended to some extent, the joint angle can be measured with the distance between the slide back plate and the table.

Further, as shown in FIG. 4*b*, the plurality of sensors for detecting the position of the slide back plate 163 may be comprised of the contact sensors spaced to a distance on one side or both sides of the table 150. The position of the slide back plate 163 can be detected by checking the respective sensors which are or are not in contact with the slide back plate moving up and down on the table 150. If the contact sensors 212 are arranged at smaller intervals, the position of the slide back plate 163 can be more precisely measured. If the contact sensors are arranged relatively crowded to one side of the table, there may cause many sensors that are not in contact with the slide back plate so that it may be checked that the slide back plate 163 is positioned far away from the pedal section 170, that is, the knee joint is extended. The position of the slide back plate 163 can be checked according to a position of the contact sensors determined to be in contact with an object.

It is obvious that in addition to the above distance sensors or contact sensors to detect the position of the slide back plate, other methods for checking the position of the slide back plate may be used as long as the methods are within the purposes of the present invention.

In order to adjust the height of the slide back plate 163, as shown in FIG. 4*c*, there are provided a fixing portion 221 fixed under the slide back plate 163, a portion of which is in contact with the pedal section, and an arm member 220 positioned inside the fixing portion 221 in such a manner that it is movably coupled with the fixing portion so as to be adjusted stepwise in length.

The arm member 220 is provided with a plurality of holes spaced to a distance. The holes of the arm member 220 are selected suitably to the user's build so that the treatment can be more stably carried out.

As shown in FIG. 4*c*, the fixing portion 221 is positioned under the slide back plate 163, more preferably, under the center line of the slide back plate 163, so as to stably move up and down the slide back plate 163. It is preferable to construct a shock-absorption member on the end of the arm member 220 to be brought into contact with the pedal section 170, so as to absorb shocks generated due to the contact with the pedal section 170. The arm member can function as a stopper determining a minimum distance between the slide back plate and the pedal section through the adjustment in length.

The pedal section 170 is spaced to a distance in a lengthwise direction of the table 150 and detachably coupled with a pair of rails 171 in such a manner that the right/left pedals 175 thereof are slidably coupled with the rails to adjust the height thereof stepwise.

Herein, a reciprocating slider 173 is coupled with each rail 171, covering the outer contour of the rail. The lower end of the reciprocating slider 173 and one end of the right/left pedal 175 are hinged. Both ends of an arm member 177 adjustable in length are movably coupled with the other ends, respectively, of the right/left pedal 175 and reciprocating slider 173. As the length of the arm member 177 is adjusted, the installation angle of the right/left pedal 175 is adjusted.

The rail 171 has an angled rod in shape, one side of which a plurality of fixing holes 171*a* is formed at constant intervals. The reciprocating slider 173 coupled with the rail 171 to slidably move includes a height fixing lever 173*a* engaged with the fixing hole 171*a* so that the right/left pedals 175 are fixed after the height thereof is adjusted.

Herein, the right/left calf support plates 179 are further detachably installed between the pair of rails 171.

The pedal section 170 makes it possible for the user to exercise using only the paralyzed lower limb, i.e., the lower limb required for rehabilitation treatment, through adjusting the heights of the right/left pedals 175 differently from each other, or otherwise removing one of rails 171 from the pedal section 170, thereby improving treatment efficiency. At this time, if the calf support plate 179 for the normal lower limb not required for the rehabilitation treatment is removed as well, the efficiency can be further improved.

The calf fixtures are provided to prevent the knee of the lower limb, that has an insufficient force for regulating a joint motion, from being lean to inside or outside of the lower limb when the user conducts flexing and extending his knees. By the calf fixtures, it is possible to exercise the flexing and extending of knees in a state that a coxa or hip joint of the user who has an insufficient force to regulate the joint motion, is in a neutral position. Since it is preferable for the user, who has an insufficient force to regulate the joint motion, not to wear the calf fixtures for more powerful treatment, the calf fixtures is constructed to be easily detachably installed on the rehabilitation equipment.

As shown in FIG. 4*d,* the calf fixture comprises a U-contact plate 230 contacting the calf portion of the user, and at least one connection rod 231 connecting the right/left pedals 175 with the contact plate 230. The connection rod 231 has a plurality of holes 232 passing through the sidewall thereof, which holes 232 are connected with the contact plate 230.

One end of the connection rod 231 is movably coupled with the right/left pedals 175, and the other end of the connection rod is movably coupled with the contact plate 230 using a hinge or a screw 233.

As not shown in the drawings, the right/left pedals 175 preferably have a plurality of connection hooks for connection with the connection rod. The connection hooks are preferably spaced apart to a distance, thereby having different heights from each other. The right/left pedals 175 and the connection rods are constructed to be easily connected to each other in a detachable fashion, so that the calf fixtures can be easily removed from equipment through the disconnection of the right/left pedals 175 from the connection rods 231.

Preferably, as shown in the drawings, at least one connection rod 231 may be provided such that one end thereof is connected with the center of the contact plate 230, and the other end thereof with the center of the pedals. The connection hooks (not shown) provided to the pedals are preferably formed at different heights. It is preferable that the connection hooks (not shown) coupled with the connection rod 231 is designated according to the located height. It is more preferable that if needed according to user, the movement range of the connection rod is restricted to prevent the hyperextension of the knee joint. That is, a minimum angle between the calf support plate and the connection rod is preset to allow the user, who has an insufficient force to flex or extend his knees, to exercise the flexing and extending of knees in a state that the user flexes his knees to some extent.

The contact plate 230 is movably coupled with the connection rod 231 so that it is automatically adjusted to the build of the calf of the lower limb. The contact plate 230 is preferably composed of a resilient material so as to be brought into contact with the calf portion of the lower limb.

Figure 9A:
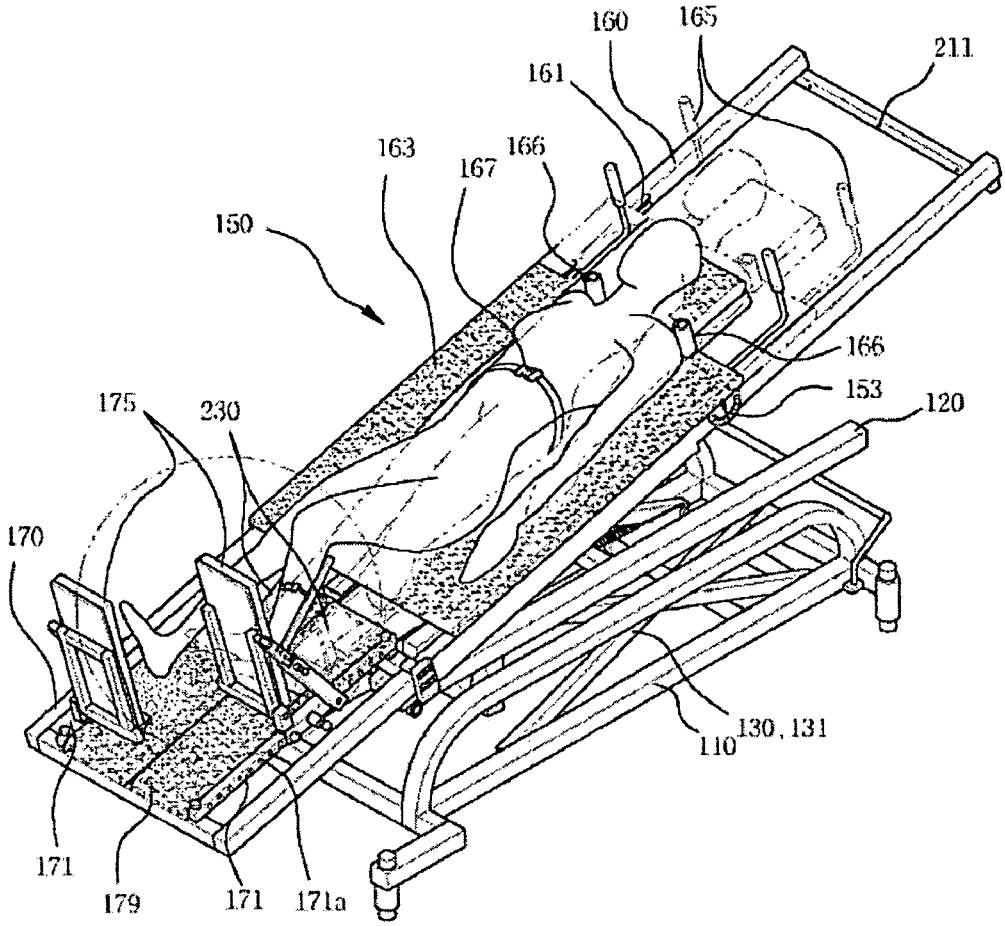
FIGS. 9*a* to 9*c* are perspective views illustrating the apparatus for lower limb rehabilitation treatment of the invention in use.
Figure 9B:
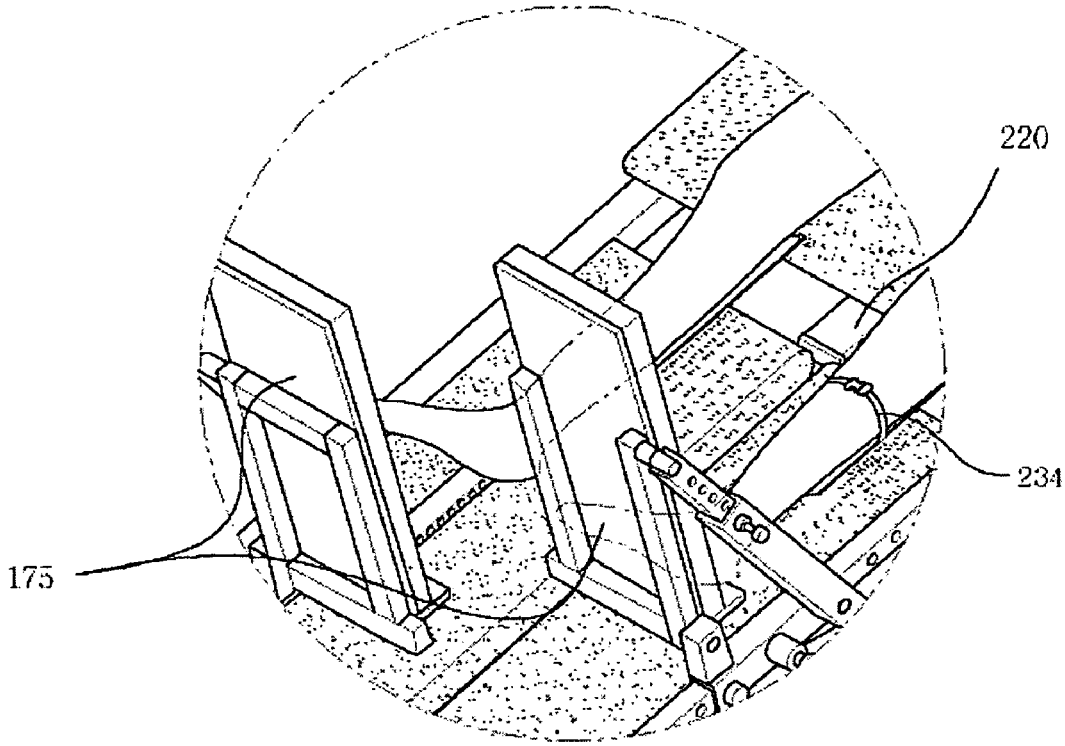
Figure 9C:
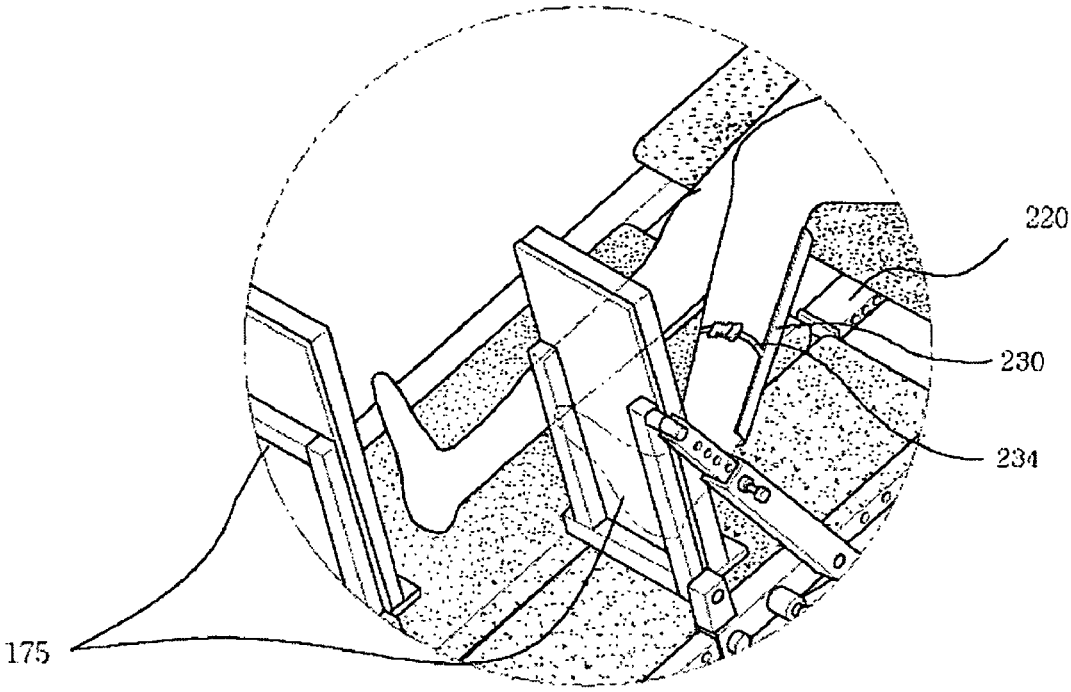

More preferably, as shown in FIGS. 9*b* and 9*c,* it is also possible to provide a belt 234 to the contact plate in order to fix the calf portion. The belt consists of two bands, each having one end connected to the contact plate and the other end having a clamp, so that the clamps are coupled to each other to fix the calf portion.

In another fixing method, a fastener (not shown) may be provided at a portion of the contact plate, which fastener is connected with the contact plate, covering the calf portion. The fastener has one end fixed to one side of the contact plate and the other end detachably fixed to the other side of the contact plate.

In order to measure a load applied to both lower limbs or one lower limb, at least one sensor (not shown) is provided at the right/left pedal 175 to be brought into direct or indirect contact with foot bottom so as to detect the varying load.

Specifically, in order to measure a load applied to one lower limb, for example, a load sensor such as a pressure sensor or a resilient device is provided. In case of the pressure sensor, a force plate may be provided in which the plurality of pressure sensors are provided at the portions of the pedal corresponding to the respective portions of the foot bottom, so that the force plate can measure the load sensed by the respective pressure sensors. In case of the resilient device, a balance, for example, may be provided which is brought into indirect contact with the foot bottom to measure the load based on the varying amount of the resilient device. The above load sensors are merely illustrative examples, so it is obvious that other constructions or methods for measuring the load applied to the foot bottom can be adapted to the rehabilitation equipment of the present invention.

As shown in the drawings, a goniometer 153 is preferably installed on one side of the table 150 so as to check a tilt angle of the table 150. The goniometer 153 may be an analog or digital type. The tilting device 180 may be comprised of a hydraulic cylinder, wherein one end thereof is supported by the lift frame 120, and the other end thereof is telescopically coupled under the table 150, thereby controlling the tilt angle of the table 150.

Herein, it may be constructed that the lift device 140 and the tilting device 180 are controlled by a remote controller 190 for user's convenience. In addition, it may be constructed that the tilt angle is controlled by a controller (not shown) as well as the remote controller to implement a treatment according to a user's state.

The controller (not shown) measures the paralysis of the user using a load applied to the lower limb and detected by the plurality of sensors positioned at the right/left pedals 175, and a joint angle obtained by the position of the slide back plate 163, to thus generate result data to be transmitted to the display 300.

As not shown in the drawings, the controller may be combined with the display 300, or otherwise, positioned on the back face of the table 150. The controller is connected with the sensors 211 and 212 for sensing the position of the slide back plate 163 and the pressure sensor (not shown) sensing the load applied to the lower limb, via wire or wireless means, and includes MPU or CPU capable of processing data received from the sensors 211 and 212, and the pressure sensor.

The controller measures the user's state varied according to the user's training through the joint angle detected in real-time by the sensor for sensing the position of the slide back plate, and the load applied to the lower limb and detected in real-time by the pressure sensor positioned at the right/left footing, to thus transmit to the display unit the measured result.

According to the rehabilitation equipment of the present invention, the amounts of work or power consumed during training are measured through measurement data including angle and load data of the slide back plate, joint angle data, and time data, and are included in result data. Result data is displayed on the display unit to inform the user.

In addition, since the repetitive rehabilitation training makes the user feel bored, there may be provided a game in which measurement data, reference data, and result data are used as variables.

The result data to be displayed may include a training target according to the user's state set through measurement data including angle and load data of the slide back plate, joint angle data, and time data, and reference data. Also, the achievement in training target may be included in result data. The user can train according to the training target to thus improve training efficiency.

The above process is described only as illustrative examples operated by the controller of the rehabilitation equipment of the present invention, so it is obvious that any other training methods can be adapted to the present invention by using various data (load data, joint angle data, and time data) obtained from the respective portions of the rehabilitation equipment of the present invention.

Figure 7:
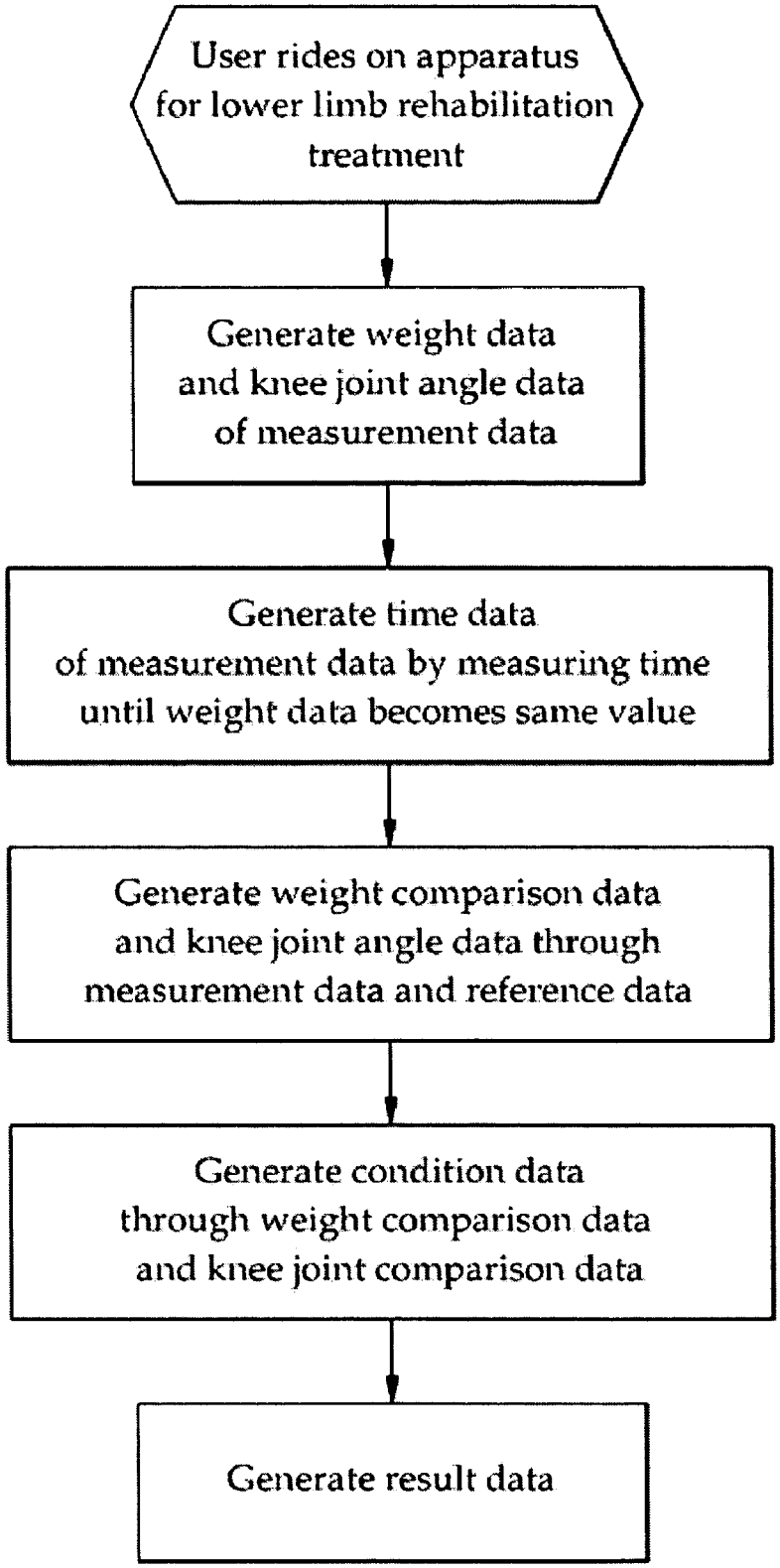
FIG. 7 is a flowchart of lower limb rehabilitation exercise where exercise target is set based on an unaffected lower limb.

FIG. 7 is a flow chart of a controller when the training target is set to the normal lower limb.

As shown in FIG. 7, the controller generates 'joint angle data of measurement data' for the user's joint angle, and 'load data of measurement data' for the load applied to the one lower limb. The controller generates load data for both lower limbs if measuring the load applied to both lower limbs, and load data for one lower limb if measuring the load applied to one lower limb. It is more preferable to generate measurement data in real-time so that data can be perceived as obtained at a measuring time.

The measurement data generated in real-time by the controller is compared with reference data for normal lower limb to check the proximity of measurement data to reference data for normal lower limb. The reference data may be preferably selected from data measured for normal lower limb and pre-stored measurement data for normal lower limb. In case of hemiplegia in which one lower limb is hemiplegic and the other is normal, the controller measures the respective lower limbs, designates the normal lower limb between both lower limbs, and generates load data and joint angle data measured for the normal lower limb as reference data. In case of treatment only for the paralyzed lower limb for efficient treatment, that is, when the pedal for the normal lower limb is removed, it is preferable that data for healthy person having similar build to the user is pre-stored, and stored measurement data for healthy person is used as reference data.

The controller compares load data and joint angle data of measurement data with reference data. In this case, the comparing is preferably conducted for data when the user and healthy person are in the same state, that is, when they take the same posture, so as to predict more precise paralysis of the user. For example, compared are reference data when the person flexes his knee to the maximum and measurement data when the user also flexes his knee to the maximum.

The controller compares load data of measurement data with load data of reference data to generate a comparison result as load comparison data. In addition, the controller compares joint angle data of measurement data with joint angle data of reference data to generate a comparison result as joint angle comparison data. Further, the controller generates state data through load comparison data and joint angle comparison data. This is for comprehensive checking of the variation in load and joint angle during treatment, so as to measure the paralysis of the user.

Various comparison methods for reference data and measurement data may be employed as long as the difference between reference data and measurement data can be detected through the method. For example, subtraction and division are implemented to reference data and measurement data to thus generate the difference between two data or ratio of two data as load comparison data and joint angle comparison data.

In addition, various methods of generating state data may be employed as long as the methods can indicate the combination of load comparison data and joint angle comparison data. For example, the added value of load comparison data and joint angle comparison data, or multiplied value of load comparison data and joint angle comparison data may be generated as state data. With the provision of state data generated through the above process to the user, the user can check his paralysis with simple value.

The controller generates result data including load data and joint angle data of measurement data, load data and joint angle data of reference data, load comparison data, joint angle comparison data, and state data, in order to transmit to the display unit 300 data for user's state and normal lower limbs.

Result data may further include time data obtained by the time until load data finally indicates the same value. Time data is measured and generated for checking the time of flexing knee because the hemiplegic user hardly flexes his knee.

In addition, the controller can generate a game using result data. Because repetitive rehabilitation training makes the user feel bored, the game aiming at treatment makes the user interested in treatment.

Examples of the game may include Tetris, castling and so on. For example, a game similar to Tetris (hereinafter will be referred to as "bricking") provides a groove in a lower part of a screen on which the game is displayed. Of course, the groove may be located in the right, left or middle. The size of the groove may be varied. As a brick drops from above, the user locate the groove formed in the lower part of the screen, and the moves his/her weight to the right or left according to the location of the groove in order to move the brick to the right or left. The user flexes or extends his/her knees to vary the size of the brick. If the brick reaches the same position and size of the groove and enters to the groove, a target is accomplished to add points. Then, a new game starts with the provision of new groove and brick. By the bricking game, the user can exercise the balanced training of the both lower limbs and flexing of knees.

In addition, a game similar to the castling (hereinafter will be referred to as "castling") increases the size of stones as more weight is loaded on the paralyzed lower limb, the joint angle is increased, or the time for maintaining such a posture is prolonged. For example, the stone size is adjusted by varying the width of the stone by the weight, the length of the stone by the joint angle, and the height of the stone by duration time. If the weight is moved by a large quantity, the knee is flexed by a large angle, and the posture is maintained by a long time, the castling is carried out with large stones. The total volume of the stones may be directly counted as scores or graded as a part of the game.

As illustrated with the Tetris and the bricking or castling, the user can be more interested in exercise by playing a game using the result data as variables of the game.

Figure 8:
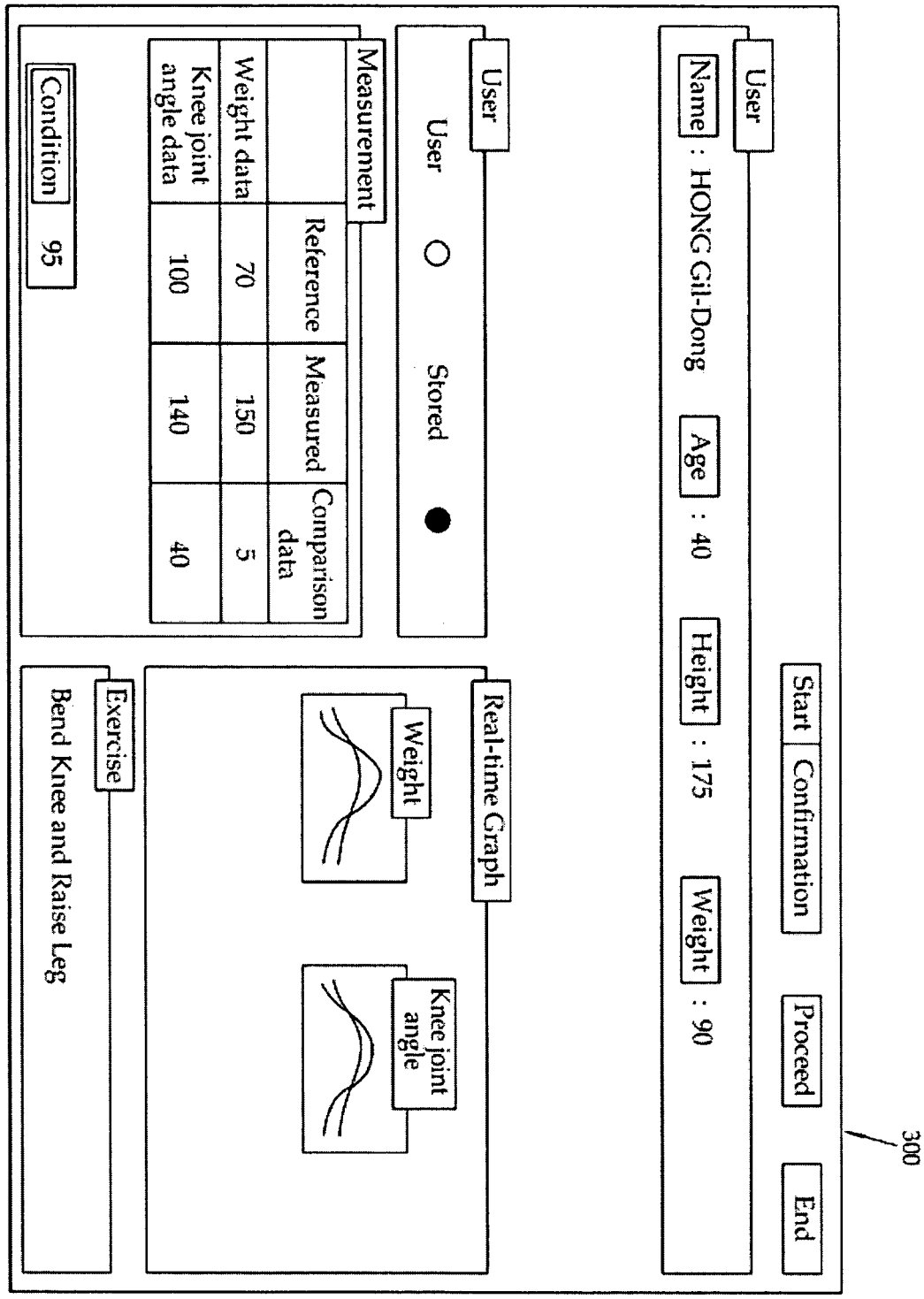
FIG. 8 is a diagram illustrating a display part of the apparatus for lower limb rehabilitation treatment of the invention.

The result data generated by the controller is transmitted to the display unit 300 so that the user can be informed of the result as shown in FIG. 8. The display unit 300 is preferably any one of a monitor, an electronic display board, an LED window, and a rehabilitation equipment dedicated monitor. As shown in FIG. 8, the items displayed on the display unit 300 may include user base information of a name, age, height, and weight of the user, an item for the selected and used reference data, a real-time graph produced in real-time by reference data and measurement data, state data indicative of the user's state as a value and so on. If the rehabilitation treatment is carried out using the game, the game can be included in the items.

In addition, the display unit 300 can be constructed such that in addition to a paralysis, a normal state is displayed so that the user can move near the normal state while perceiving both states. The result data outputted from the display unit 300 may be real-time varying graph, texts, or numerals, which, however, are merely illustrative so that any items that the user can easily perceive his/her state can be displayed on the display unit.

FIGS. 9*a* to 9*c* illustrate an example in which a user makes use of a lower-limb rehabilitation apparatus according to the present invention.

Before making use of a lower-limb rehabilitation apparatus, a user adjust heights of the slide back plate 163 and left/right footings 175 depending on his/her physical features. As mentioned above, the height of slide back plate 163 is adjusted by adjusting a distance of the arm member 220 in the fixture 221 located on the lower portion of the slide back plate 163. Further, the heights of the left/right footings 175 are adjusted by adjusting the arm members 177 provided to the left/right footings 175.

Then, as illustrated in FIG. 9*a,* the user lies on the slide back plate 163 that is tilted at a predetermined angle with his/her weight supported against the left/right footings 175. A tilt of the slide back plate 163 can be adjusted before or after lying. For more stable posture after lying on the slide back plate 163, the user can adjust the tilt of the slide back plate 163 by means of the remote controller 190 of a tilt adjustor or a controller (not shown).

At this time, as illustrated in FIGS. 9*b* and 9*c,* a calf of the user is adapted to be wrapped in the contact plate 230 of a calf fixing part. Thus, as the user flexes or extends a knee, the contact plate 230 of the cal fixing part moves together with the calf of the user. Thereby, the knee is preferably prevented from being rotated inward or outward the lower limb. More preferably, the contact plate 230 can be fully fixed to the calf using an attachment portion 234 of the contact plate 230.

Thus, the left/right footings 175 support the weight of the user, and the upper part of the user's body assumes a high posture, whereas the lower part of the user's body assumes a low posture. Then, as illustrated in FIGS. 9*b* and 9C, the user repeats flexing and extending of the knees. At this time, the lower-limb rehabilitation apparatus measures a magnitude of the load applied to each lower limb and an angle of each joint in real time, compares a motion state of the user which can be predicted from the measured values with a motion state of a normal lower limb of the user, and displays the compared result to the user through a display part.

Hereinafter, rehabilitation examples of using the lower-limb rehabilitation apparatus according to the present invention constructed as mentioned above will be described. In order to more accurately measure use of muscular strength in the following example, a precise apparatus for measuring the user of muscular strength is used. However, the lower-limb rehabilitation apparatus according to the present invention is adapted to enable the user to check whether to get an exercise using the muscular strength or how about the motion state through the magnitude of the load applied to the lower limb and the angle of the joint, although the foregoing measurement apparatus is separately provided.

First, this test was directed to a 67-year-old male patient, a subject, who had a good muscular strength on an affected or paralyzed side, could independently achieve functional ambulation, and had a left hemiplegia.

After active electrodes were attached to both vastus lateralis muscles, and reference electrodes were attached on both knees using a dynamic electromyograph for the subject, standing in a sitting posture (i.e. sit-to-stand), flexion and extension of both knee joints on a stall bar, and flexion and extension of both knee joints at the apparatus for rehabilitating the paralyzed lower limb according to the present invention are performed. At this time, muscular activities representing the vastus lateralis muscles were measured, and then left and right differences based on the respective movements were compared.

First, while the sit-to-stand was repeated twice, the muscular activities at the vastus lateralis muscles were measured. After taking a rest for 10 minutes whenever examining a different motion, while flexing and extending of both knees on the stall bar and the apparatus for rehabilitating the paralyzed lower limb according to the present invention were performed twice in the same method, the muscular activities at the vastus lateralis muscles were measured as in Table 1 above.

First, the mean potential values at the vastus lateralis muscles obtained while the sit-to-stand was repeated twice showed 0.622V for right and 0.471V for left, and thus the left/right ratio was 0.76.

When the flexion and extension of the knee joints on the stall bar were repeated twice, the recorded mean potential values at the vastus lateralis muscles showed 0.281V for right and 0.216V for left, and thus the left/right ratio was 0.77.

When the flexion and extension of the knee joints using both lower limbs at the apparatus for rehabilitating the paralyzed lower limb according to the present invention were repeated twice, the recorded mean potential values at the vastus lateralis muscles showed 0.241V for right and 0.219V for left, and thus the left/right ratio was 0.91.

When the flexion and extension of the knee joints using only one affected lower limb at the apparatus for rehabilitating the paralyzed lower limb according to the present invention were repeated twice, the recorded mean potential values at the vastus lateralis muscles showed 0.072V for right and 0.427V for left, and thus the left/right ratio was 5.93.

As can be seen through the results as shown in Table 1, it can be found that the unaffected vastus lateralis muscle had a higher muscular activity than the affected vastus lateralis muscle when the subject performed the sit-to-stand, the flexion and extension of both knee joints on a stall bar, and the flexion and extension of both knee joints using both lower limbs at the apparatus for rehabilitating the paralyzed lower limb according to the present invention, but the muscular activity at the unaffected vastus lateralis muscle was remarkably decreased, whereas the muscular activity at the affected vastus lateralis muscle was relatively increased when the subject performed the flexion and extension of both knee joints using only one affected limb at the apparatus for rehabilitating the paralyzed lower limb according to the present invention.

Further, it can be found that the ratio of the muscular activities at the affected and unaffected vastus lateralis muscles was remarkably increased as compared to other motion, when the subject makes a motion using only one affected limb at the apparatus for rehabilitating the paralyzed lower limb according to the present invention.

As set forth above, the apparatus for rehabilitating the paralyzed lower limb according to the present invention makes possible obstructive orbital motion, eccentric motion, and concentric motion of the affected limb at the same time including coercive use of the affected limb, can adjust a motion load by adjusting the slant, and can quantify the motion.

Further, on getting an exercise for a load of body's weight on the affected limb, there is a need for help from a therapist. However, the apparatus for rehabilitating the paralyzed lower limb according to the present invention is so designed that manipulation using the remote controller 190 is easy, and the patient is easy to get on and off the table 150, so that the patient and his/her curator can easily get an exercise without help of the therapist.

Further, the invention measures the magnitude of the load and the angle of the joint showing the quantity of the motion of the lower limb, so that the user can recognize his/her own state without using the auxiliary apparatus for measuring muscular activities.

The invention also introduces game techniques into the exercise, so that the user who performs repeated motions and rehabilitation can be stimulated with interest in rehabilitation exercise.

While the present invention has been shown and described in connection with the preferred embodiments, it will be apparent to those skilled in the art that modifications and variations can be made without departing from the spirit and scope of the invention as defined by the appended claims.

Thus, the technical protection scope of the invention is not limited to the disclosures recited in the detailed description of the specification, but should be defined by the claims.

According to the present invention, the muscular activity at the unaffected vastus lateralis muscle is remarkably decreased, and the muscular activity at the affected vastus lateralis muscle is relatively increased by making possible coercive use of the paralyzed lower limb when the subject performed the flexion and extension of both knee joints using only one affected limb. Furthermore, it is possible to make an obstructive orbital motion, eccentric motion, and concentric motion of the affected limb at the same time including the coercive use of the affected limb, to adjust a motion load by adjusting the slant, and to quantify the motion.

Further, when getting an exercise for a load of body's weight on the affected limb, there is a need for help from a therapist. However, the apparatus for rehabilitating the paralyzed lower limb according to the present invention is so designed that manipulation using the remote controller is easy, and the patient is easy to get on and off the table, so that the patient and his/her curator can easily get an exercise without help of the therapist.

What is claimed is:

1. An apparatus for lower limb rehabilitation comprising:

a base frame supported on a bottom;

an elevation frame arranged to be driven up/down to a predetermined height from the base frame, in parallel therewith;

a variable jig for supporting the elevation frame above the base frame, allowing the elevation frame to be driven up/down;

an elevator arranged on the base frame for adjusting an axial width of the variable jig in order to drive up/down the elevation frame;

a table including a pivotal coupling part formed in a lower position for pivoting with one edge of the elevation frame as a vertex, a backing plate part having a sliding backing plate arranged above the pivotal coupling part for sliding up and down while supporting an upper body of a patient, and a pair of footings arranged on a lower side of the backing plate part to support a weight of the patient, each of the footings being adjustable in height; and a tilt-adjusting unit mounted on the elevation frame for driving the table to pivot to a predetermined angle about the pivotal coupling part to erect or lie.

2. The apparatus for lower limb rehabilitation according to claim 1, wherein the variable jig has a hinge part including two bars at an X-shaped crossing and upper and lower ends of one side of the hinge part are pivotally fixed to the elevation frame and base frame, respectively.

3. The apparatus for lower limb rehabilitation according to claim 1, wherein the backing plate part has a number of rolling bearings at both sides underneath the sliding backing plate, the rolling bearings inserted into guide rails arranged at both sides of the table to enable rolling, so that the sliding backing plate supporting the weight of the patient smoothly slides up and down at an entire, adjustable slant angle of the table.

4. The apparatus for lower limb rehabilitation according to claim 3, further comprising shoulder supports arranged at both sides of the sliding backing plate to support shoulders of the patient, respectively, so that when the sliding backing plate is slid up, the weight of the sliding backing plate is supported on the shoulders of the patient.

5. The apparatus for lower limb rehabilitation according to claim 1, wherein the footings are separated from each other to a suitable distance in the longitudinal direction of the table, and coupled with a pair of rails, respectively, in a slidable fashion, thereby enabling stepwise height adjustment.

6. The apparatus for lower limb rehabilitation according to claim 5, further comprising reciprocating sliders to surround the exterior of the rails, respectively, wherein lower ends of the reciprocating sliders are hinged to one ends of the both footings, respectively, both ends of arm members are pivotally coupled to the other ends of the both footings and the other ends of the reciprocating sliders, respectively.

7. The apparatus for lower limb rehabilitation according to claim 5, further comprising a pair of calf-backing plates detachably arranged between the rails, wherein one of the calf-backing plates for an unaffected lower limb is removed in partial paralysis rehabilitation treatment so that a partially paralyzed lower limb is exercised intensively.

8. The apparatus for lower limb rehabilitation according to claim 1, further comprising a goniometer arranged at one lateral side of the table.

9. An apparatus for lower limb rehabilitation comprising:

a base frame supported on a bottom;

an elevation frame arranged to be driven up/down to a predetermined height from the base frame, in parallel therewith;

a variable jig for supporting the elevation frame above the base frame, allowing the elevation frame to be driven up/down;

an elevator arranged on the base frame for adjusting an axial width of the variable jig in order to drive up/down the elevation frame;

a table including a pivotal coupling part formed in a lower position for pivoting with one edge of the elevation frame as a vertex, a backing plate part having a sliding backing plate arranged above the pivotal coupling part for sliding up and down while supporting an upper body of a patient, the backing plate part capable of detecting a vertical position of the sliding backing plate, a pair of footings arranged on a lower side of the backing plate part to support the patient, each of the footings being adjustable in height and capable of measuring a load applied by the patient thereon, and a calf-fixing part for contacting calves of lower limbs to prevent knees of the patient from biasing inward or outward of the lower limbs;

a tilt-adjusting unit mounted on the elevation frame for driving the table to pivot to a predetermined angle about the pivotal coupling part to erect or lie;

a controller for generating a measurement data of the patient, the measurement data including measured joint angle data of measurement of an angle of a joint by determining the angle of the joint based upon the position of the sliding backing plate detected by the backing plate part, and measured weight data of measurement of a weight of the patient loaded on each of the lower limbs detected by each of the footings, and the controller generating result data based upon both reference weight data and joint angle data and the measurement data of the patient, the reference weight data and joint angle data being obtained from a normal lower limb; and a display part for displaying the result data generated by the controller.

10. The apparatus for lower limb rehabilitation according to claim 9, wherein the variable jig has a hinge part including two bars at an X-shaped crossing, and upper and lower ends of one side of the hinge part are pivotally fixed to the elevation frame and base frame, respectively.

11. The apparatus for lower limb rehabilitation according to claim 9, wherein the backing plate part has a number of rolling bearings at both sides underneath the sliding backing plate, the rolling bearings inserted into guide rails arranged at both sides of the table to enable rolling, so that the sliding backing plate supporting the weight of the patient smoothly slides up and down at an entire, adjustable slant angle of the table.

12. The apparatus for lower limb rehabilitation according to claim 11, further comprising shoulder supports arranged at both sides of the sliding backing pate to support shoulders of the patient, respectively, so that when the sliding backing plate is slid up, the weight of the sliding backing plate is supported on the shoulders of the patient.

13. The apparatus for lower limb rehabilitation according to claim 9, wherein the backing plate part has a number of distance sensors arranged in a top portion of the table for locating the sliding backing plate, whereby the distance sensors detect a distance from the top portion of the table to the sliding backing plate to locate the sliding backing plate.

14. The apparatus for lower limb rehabilitation according to claim 9, wherein the backing plate part has a number of contact sensors arranged in one or both sides of the table at a predetermined interval, for locating the sliding backing plate, whereby the sliding backing plate is located by detecting the position of each of the sensors contacted by the sliding backing plate.

15. The apparatus for lower limb rehabilitation according to claim 9, further comprising a fixing part attached to a bottom portion of the sliding backing plate, wherein arm members are pivotally coupled inside the fixing part, whereby the sliding backing plate is adjusted in height through the distance adjustment of the arm members.

16. The apparatus for lower limb rehabilitation according to claim 9, wherein the footings are separated from each other to a suitable distance in the longitudinal direction of the table, and coupled with a pair of rails, respectively, in a slidable fashion, thereby enabling stepwise height adjustment.

17. The apparatus for lower limb rehabilitation according to claim 16, further comprising reciprocating sliders to surround the exterior of the rails, respectively, wherein lower ends of the reciprocating sliders are hinged to one ends of the both footings, respectively, both ends of arm members are pivotally coupled to the other ends of the both footings and the other ends of the reciprocating sliders, respectively.

18. The apparatus for lower limb rehabilitation according to claim 16, further comprising a pair of calf-backing plates detachably arranged between the rails.

19. The apparatus for lower limb rehabilitation according to claim 9, wherein the footings have a number of sensors directly or indirectly contacting lower surfaces of the lower limbs of the patient, the sensors changing state owing to the weight loaded on the lower limbs, whereby the weight loaded on the lower limbs is detected based upon the state changes of the sensors.

20. The apparatus for lower limb rehabilitation according to claim 9, wherein the calf-fixing part includes a U-shaped contact plate adapted to contact the calves of the patient, connecting hooks placed between the footings and the contact plate and arranged in different heights on the footings and at least one connecting rod pivotally coupled with a portion of the contact plate, wherein the connecting hooks of the contact plate are selectable to match the figure of the patient.

21. The apparatus for lower limb rehabilitation according to claim 20, wherein the contact plate further includes an attachment that surround a calf of each lower limb of the patient and adapted to completely contact the calf, one portion of the attachment fixed to one portion of the contact plate and the other portion of the attachment attachable/detachable to/from the other portion of the contact plate.

22. The apparatus for lower limb rehabilitation according to claim 9, further comprising a goniometer arranged at one lateral side of the table.

23. The apparatus for lower limb rehabilitation according to claim 9, wherein a reference data is measurement data obtained from paralyzed and unaffected lower limbs or stored measurement data of an unaffected person.

24. The apparatus for lower limb rehabilitation according to claim 9, wherein the controller has a timer, and is adapted to measure, with the timer, time until the weight data of measurement data becomes a same value in next time, generate time data from the measured time, and adding the time data to the measurement data.

25. The apparatus for lower limb rehabilitation according to claim 24, wherein the result data includes the time data.

26. The apparatus for lower limb rehabilitation according to claim 9, wherein the controller is adapted to generate a game using the result data as variables and forward the game to the display part, thereby to stimulate the patient to feel more interest in the exercise.

27. The apparatus for lower limb rehabilitation according to claim 25, wherein the controller is adapted to generate a game using the result data as variables and forward the game to the display part, thereby to stimulate the patient to feel more interest in the exercise.

28. A method for lower limb rehabilitation treatment using the apparatus as defined in claim 9, the method comprising steps of:

(a) measuring a weight load on at least one lower limb detected by at least one of the footings, based upon state change of a pressure sensor or a spring of the footings, to generate weight data of measurement data about the loaded weight, and measuring an angle of a flexed joint of a patient based upon the position of the sliding backing plate detected by sensors of the backing plate part to generate joint angle data of measurement data about the measured joint angle;

(b) generating weight data and joint angle data of reference data comprising measurement data measured from paralyzed and unaffected lower limbs or measurement data of an unaffected person as data of an unaffected lower limb comparable with the weight data and joint angle data of measurement data;

(c) generating state data through the weight data of measurement data and the weight data of reference data;

(d) generating result data including the weight data and joint angle data of reference data, the weight data and joint angle data of measurement data and the state data; and (e) outputting and displaying the result data to the patient.

29. The method for lower limb rehabilitation according to claim 28, further comprising steps of: adding, to the measurement data, time data obtained by measuring time until the weight data of measurement data becomes a same value; and adding the time data of measurement data to the result data.

30. The method for lower limb rehabilitation according to claim 28, further comprising a step of receiving basic information of the patient before the step (a).

31. The method for lower limb rehabilitation according to claim 29, wherein basic information of the patient is used to generate the reference data.

* * * * *